US007850072B2

(12) United States Patent
Yoshioka

(10) Patent No.: US 7,850,072 B2
(45) Date of Patent: Dec. 14, 2010

(54) BILLING PROCESS APPARATUS

(75) Inventor: Kazuei Yoshioka, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 341 days.

(21) Appl. No.: 12/024,374

(22) Filed: Feb. 1, 2008

(65) Prior Publication Data

US 2008/0187209 A1 Aug. 7, 2008

(30) Foreign Application Priority Data

Feb. 2, 2007 (JP) ..... 2007-024317

(51) Int. Cl.
*G06Q 40/00* (2006.01)

(52) U.S. Cl. ..... 235/379; 235/475; 235/486

(58) Field of Classification Search ..... 235/379, 235/486, 475; 194/351, 350
See application file for complete search history.

(56) References Cited

U.S. PATENT DOCUMENTS 4,585,144 A * 4/1986 Granzow et al. ..... 221/7
6,176,423 B1 * 1/2001 Egami ..... 235/379
7,143,933 B2 * 12/2006 Uematsu et al. ..... 235/379

FOREIGN PATENT DOCUMENTS

JP 2006-264977 10/2006

* cited by examiner

*Primary Examiner*—Thien M. Le
*Assistant Examiner*—Tuyen K Vo
(74) *Attorney, Agent, or Firm*—Arent Fox LLP

(57) ABSTRACT

In a bill processing apparatus 1 according to an embodiment of the invention, a lock device 400 is mechanically operated in connection with the movement of a loading tray 60 that is moved by a movement device 70. Accordingly, it is possible to drive the lock device 400 as well as the movement device 70 using only a driving source of the movement device 70. Therefore, it is possible to drive the lock device 400 with low power consumption. In addition, since it is not necessary to provide a driving source for driving the lock device 400, the number of parts is decreased and the entire apparatus is thus made to be small.

10 Claims, 26 Drawing Sheets

BILLING PROCESS APPARATUS

CROSS REFERENCE TO RELATED APPLICATION

This application is based upon and claims the benefit of priority from the prior Japanese patent Application No. 2007-024317, filed on Feb. 2, 2007.

BACKGROUND OF THE INVENTION

1. Field of the Invention

The invention relates to a bill processing apparatus that is equipped in a game arcade, in which a pachinko machine or slot machine (hereinafter, collectively referred to as "gaming machine") is provided, and can be disposed between the gaming machines or in the gaming machine.

2. Description of the Related Art

In general, in a game arcade such as pachinko hall, in order to meet the convenience of a player, a game medium lending device for lending pachinko beads or coins (game media) between adjacent gaming machines is provided in areas (also referred to as "island") in which the gaming machines are equipped. The game medium lending device is mounted on a frame that is fixedly provided between the respective gaming machines and is adapted to actually lend a game medium or to transmit a signal urging a lending of the game medium to a gaming machine, when bill, coin, prepaid card and the like is inserted into a corresponding insertion slot.

For example, a bill processing apparatus that is generally included in the game medium lending device comprises a bill insertion slot in which bill is inserted, a delivery device that delivers the inserted bill, a bill validator that identifies a validity of the inserted bill and a bill receiver (cashbox) that stacks the bill that is determined to be valid in the bill validator. In addition, the bill processing apparatus comprises a bill collection slot so as to collect the bill stacked in the bill receiver, an openable shutter (shield plate) that shuts the bill collection slot, a movement device that moves the bill receiver to the bill collection slot, and a shutter lock device that prevents the shutter from being opened except when the bill is collected, i.e., locks a shut state of the shutter, as disclosed in a Japanese Patent Unexamined Publication No. 2006-264977.

SUMMARY OF THE INVENTION

However, in the bill processing apparatus disclosed in the Japanese Patent Unexamined Publication No. 2006-264977, a driving source of the movement device that moves the bill receptor toward the bill collection slot and a driving source for driving the shutter lock device are separately provided. To be more specific, a motor for driving the movement device and a solenoid for driving the shutter lock device are provided. As a result, the power consumption is high and the number of parts is increased to enlarge the entire apparatus.

The invention has been made to solve the above problem. Accordingly, an object of the invention is to provide a bill processing apparatus capable of driving a movement device that moves a bill receptor toward a bill collection slot and a lock device that locks a shield plate into a shut state, with low power consumption.

In order to achieve the above object, there is provided a bill processing apparatus comprising: a bill receiver that receives a bill inserted through a bill insertion slot and delivered; a bill collection slot that collects the bill received in the bill receiver; an openable shield plate that shuts the bill collection slot; a movement device that moves the bill receiver toward the bill collection slot; and a lock device that locks a shut state of the shield plate to be released. The lock device is mechanically operated in connection with the movement of the bill receiver that is moved by the movement device.

According to the above structure, since the lock device is mechanically operated in connection with the movement of the bill receiver that is moved by the movement device, it is possible to drive the lock device as well as the movement device using only a driving source of the movement device. Therefore, it is possible to drive the lock device with low power consumption. In addition, since it is not necessary to provide a driving source for driving the lock device, the number of parts is decreased and the entire apparatus is thus made to be small.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, an embodiment of the invention will be described with reference to the drawings.

Figure 1:
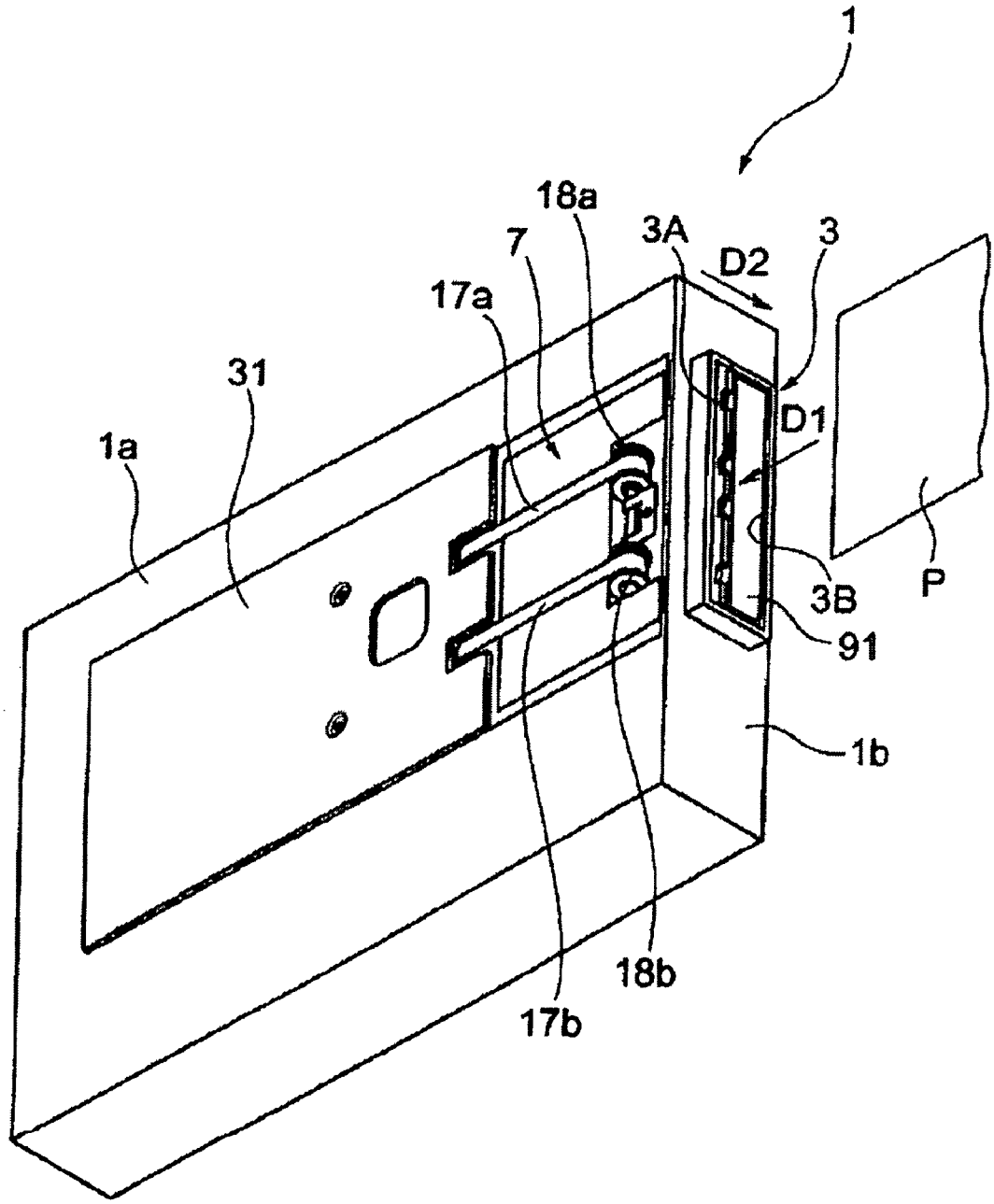
FIG. 1 is a perspective view showing an entire structure of a bill processing apparatus according to an embodiment of the invention.
Figure 2:
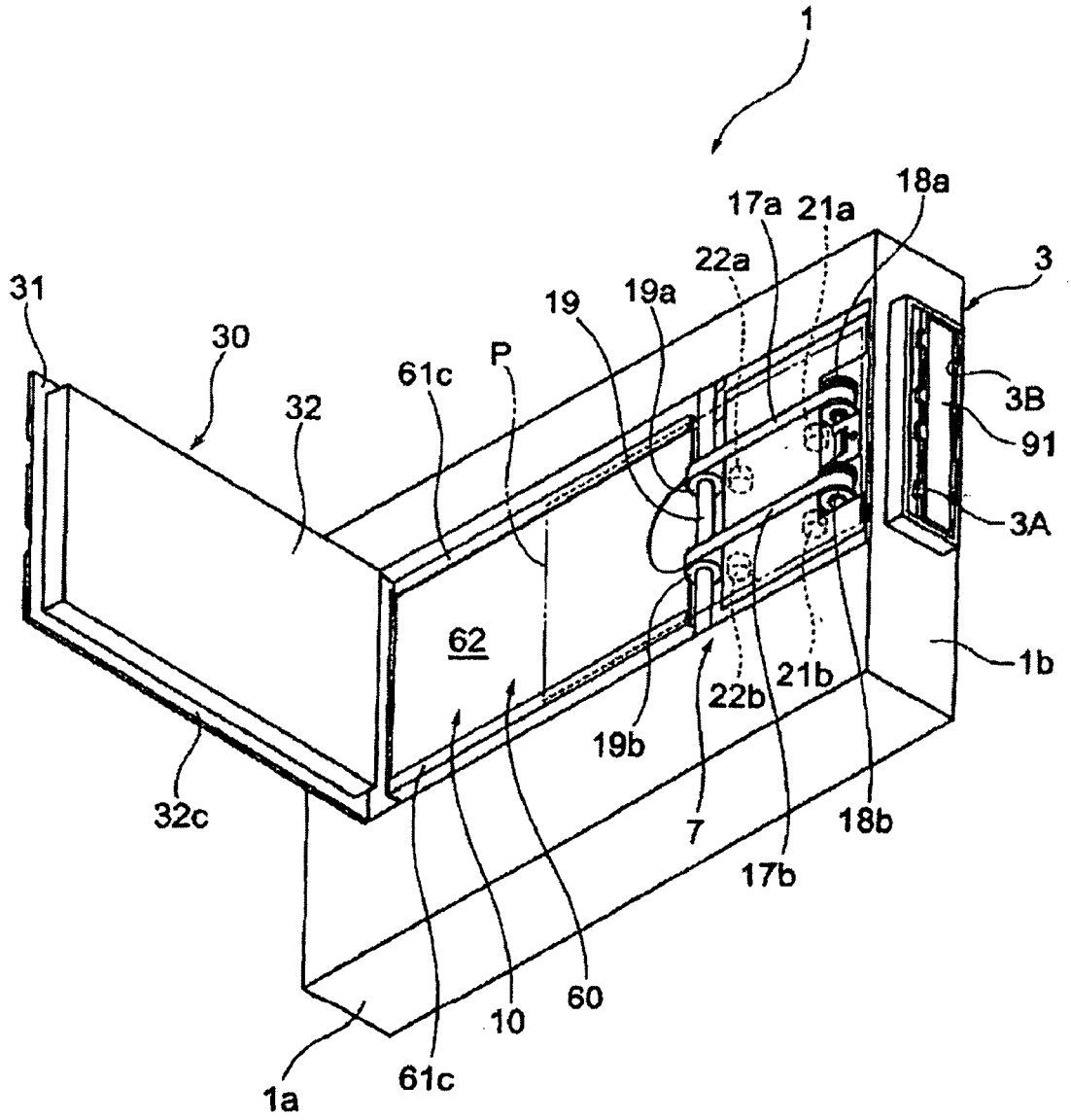
FIG. 2 is a perspective view showing a state in which a cover shown in FIG. 1 is opened.
Figure 3:
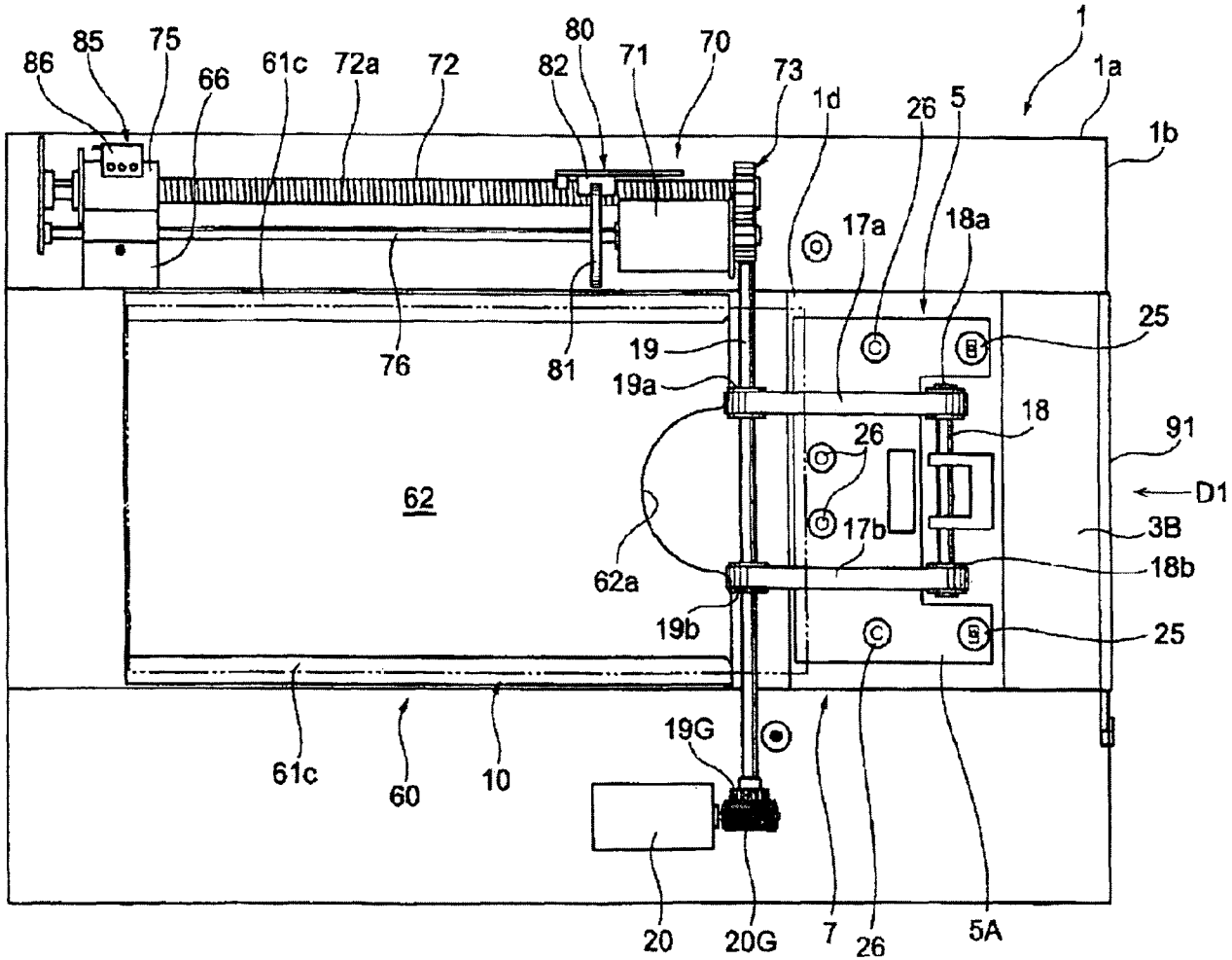
FIG. 3 is a plan view of an internal structure of a bill processing apparatus, seen from a press plate.
Figure 4:
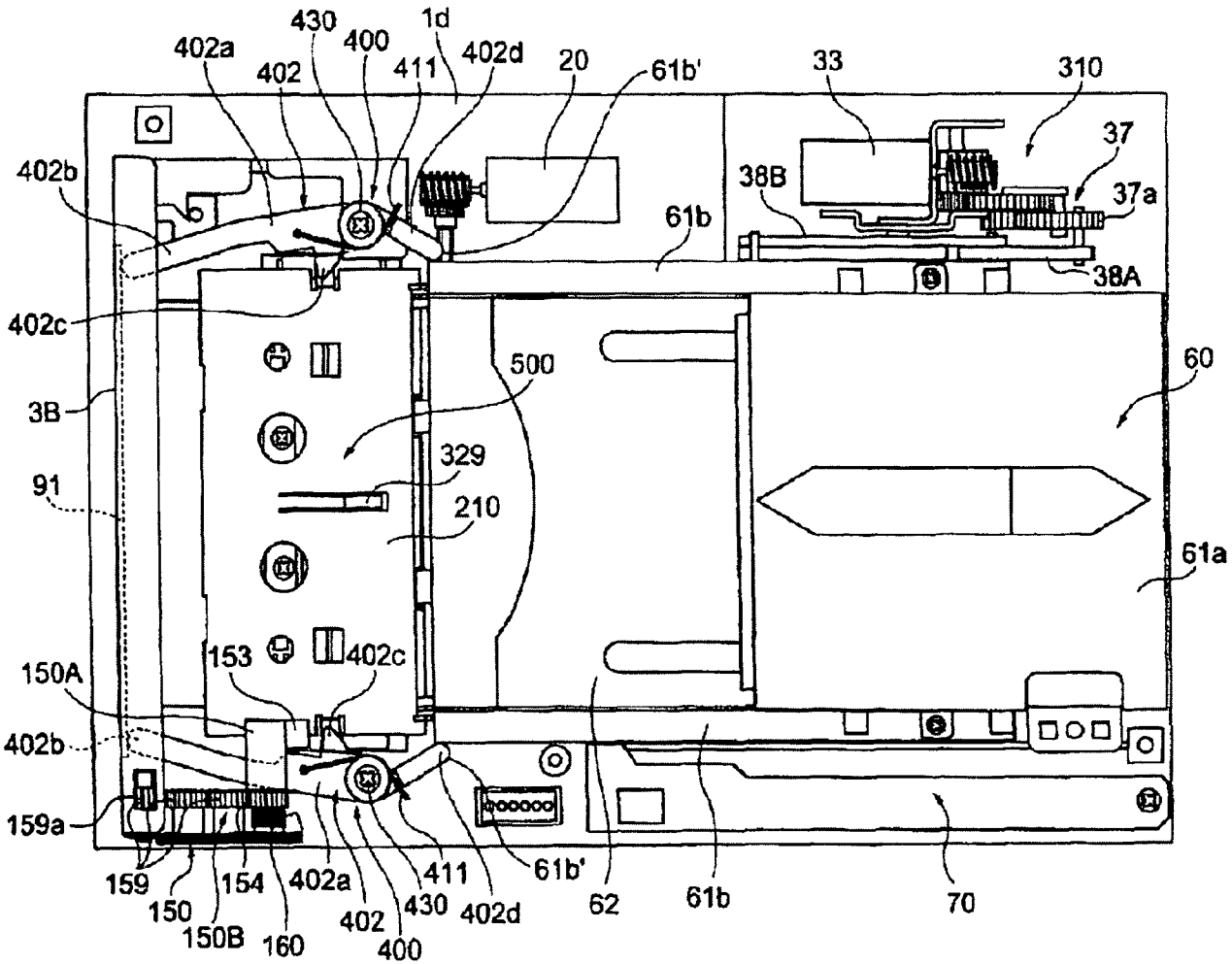
FIG. 4 is a plan view of an internal structure of a bill processing apparatus, seen from an opposite side to FIG. 3.

FIGS. 1 to 4 show a structure of a bill processing apparatus 1 according to the embodiment, wherein FIG. 1 is a perspective view showing an entire structure, FIG. 2 shows a state in which a cover shown in FIG. 1 is opened, FIG. 3 is a plan view showing an internal structure, seen from an opposite side to that shown in FIG. 2, and FIG. 4 is a plan view showing an internal structure, seen from a side shown in FIG. 2.

The bill processing apparatus 1 is structured so that it can be equipped in a game medium lending device provided between gaming machines such as pachinko machine (not shown). In this case, although the game medium lending device is equipped at a lower or upper part of the bill processing apparatus 1 with the other devices (for example, coin validator, recording medium processing apparatus, power supply device and the like), the bill processing apparatus 1 may be integrated with or separately provided from the other devices. Alternatively, the bill processing apparatus 1 may be independently or in connection with the other devices in another space rather than between the gaming machines. When bill P is inserted into the bill processing apparatus 1 and a validity of the bill P inserted is determined, a lending process of a game medium in accordance with a bill value thereof, a recording process to a recording medium and the like are performed.

The bill processing apparatus 1 has a cabinet 1*a* that is formed into a rectangular parallelepiped shape and is mounted to an engagement part of the game medium lending device. To a front face 1*b* (an exposed face) of the cabinet 1*a* is formed a bill processing area 3. The bill processing area 3 has a bill insertion slot 3A that is opened in a slit shape and into which the bill P is introduced, and a bill collection slot 3B that is formed adjacent to the bill insertion slot 3A and is provided to discharge a loading tray (bill receiver) having the bill P stacked thereon (i.e., to collect the bill P received in the bill receiver). The bill collection slot 3B is shut by means of an openable shield plate 91. In this case, the bill P is inserted through the bill insertion slot 3A along an arrow D1 direction with its small sides being in a vertical direction (raised state).

In the cabinet 1*a*, it is provided a bill validator 5 that identifies validity of the bill P inserted, and a bill delivery device 7 that delivers the inserted bill P along a predetermined bill delivery passage. The bill validator 5 is provided adjacent to an insertion direction of the bill insertion slot 3A and the bill delivery device 7 is provided over an area from the bill validator 5 to the insertion direction D1. In this case, the bill delivery device 7 has a function of delivering the inserted bill P while holding it and is sized to be shorter than a lengthwise length of the bill P, preferably to be within a range of a half or less of the length of the bill P at a position adjacent to the insertion direction of the bill insertion slot 3A.

In the mean time, a bill press area 10, which slidingly moves the bill P discharged by a pair of downstream rollers constituting the bill delivery device, is provided downstream of the bill delivery device 7. The bill press area 10 has an approximately same size as that of the bill P so that it can deliver the bill P discharged from the downstream rollers, as it is, toward an arrow direction D2 orthogonal to the discharge direction, without any restriction. Like this, the bill press area 10 is located downstream of the bill delivery device 7 and a bill press device 30 is positioned at one side of the cabinet and a loading tray (bill receiver) 60 is positioned at the other side while interposing the bill press area 10 (refer to FIG. 2). In other words, the bills P, which are discharged to the press area 10 by a delivery driving of the bill delivery device 7, are pressed, as they are, by a press plate of the bill press device 30 toward the arrow direction D2 and then sequentially stacked in the loading tray 60.

The bill delivery device 7 is provided with a pair of delivery belts 17*a*, 17*b* that are extended along the bill insertion direction D1 and located at a predetermined distance. Each of the delivery belts 17*a*, 17*b* has one end that is wound on tension rollers 18*a*, 18*b* that are attached to a spindle 18 rotatably supported to an inner frame 1*d* in the bill insertion slot 3A and the other end that is wound on tension rollers 19*a*, 19*b* that are attached to a spindle 19 rotatably supported to the inner frame 1*d* within the bill validator 5.

The spindle 19 is adapted to rotate by a delivery motor 20 disposed at the inner frame 1*d*. In other words, the spindle 19 is adapted to rotate by a gear 20G that is fixed to a driving axis of the delivery motor 20 and a gear 19G that is fixed to an end of the spindle 19 with being engaged with the gear 20G. The delivery motor 20 is controlled to rotate/counter-rotate by a control unit that will be described later, and has a function as a driving source of the bill delivery device 7.

Figure 18A:
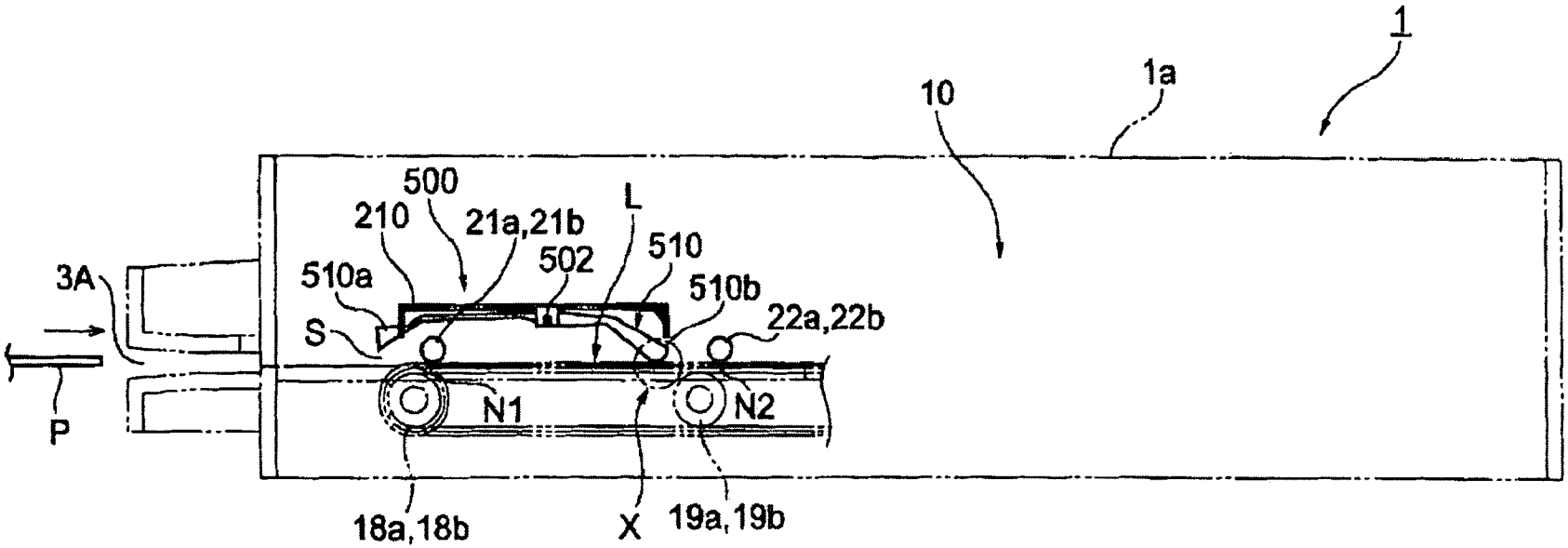
FIG. 18A shows a delivery operation of introducing bill in a press area through a bill insertion slot.

The tension rollers 18*a*, 18*b* and the tension rollers 19*a*, 19*b* that are equipped to both ends are contacted to pinch rollers 21*a*, 21*b* and pinch rollers 22*a*, 22*b*, respectively. In this case, as shown in FIG. 18A, the bill P, which is inserted into the bill insertion slot 3A, is guided into a nip portion N1 between the tension roller 18*a* (18*b*) and the cinch roller 21*a* (21*b*) by a guide (not shown) provided in the cabinet, then delivered with being held therebetween and is finally discharged to the bill press area 10 through a nip portion N2 between the tension roller 19*a* (19*b*) and the pinch roller 22*a* (22*b*). Meanwhile, the tension rollers on which the delivery belt is wound may be located at intermediated positions, rather than both ends thereof.

The bill validator 5 has a sensor substrate 5A to which a bill insertion sensor 25 is provided nearer to the bill insertion slot 3A than the spindle 18. The bill insertion sensor 25 consists of an optic sensor, for example and detects that the bill P is inserted into the bill insertion slot 3A. When the bill insertion sensor 25 detects that the bill P is inserted, a control unit, which will be described later, rotates the delivery motor 20 in the bill delivery direction.

In addition, the sensor substrate 5A is provided between the spindle 18 and the spindle 19 with bill validating sensors 26. The bill validating sensors 26 consist of optic sensors so as to illuminate light to the bill P when the bill P is delivered by the bill delivery device 7. The bill validating sensors 26 are provided along a direction orthogonal to the bill insertion direction D1. The CPU of the control unit compares detection data, which is obtained by reflected light or transmissive light from the bill P, with the data about the normal bill P, which is stored in the ROM in advance, and determines whether the bill P is normal or not.

In the bill press area 10, a bill press device 30 is provided at one side of the cabinet 1*a*. The bill press device 30 comprises a cover 31 that is openable for the cabinet 1*a*, a press plate 32 of a plate type that is provided to the cover 31 and presses the bill P in the arrow direction D2 when the bill P is located in the bill press area 10 with the cover 31 being closed for the cabinet 1*a*, and a plate drive motor that drives the press plate 32.

Figure 6:
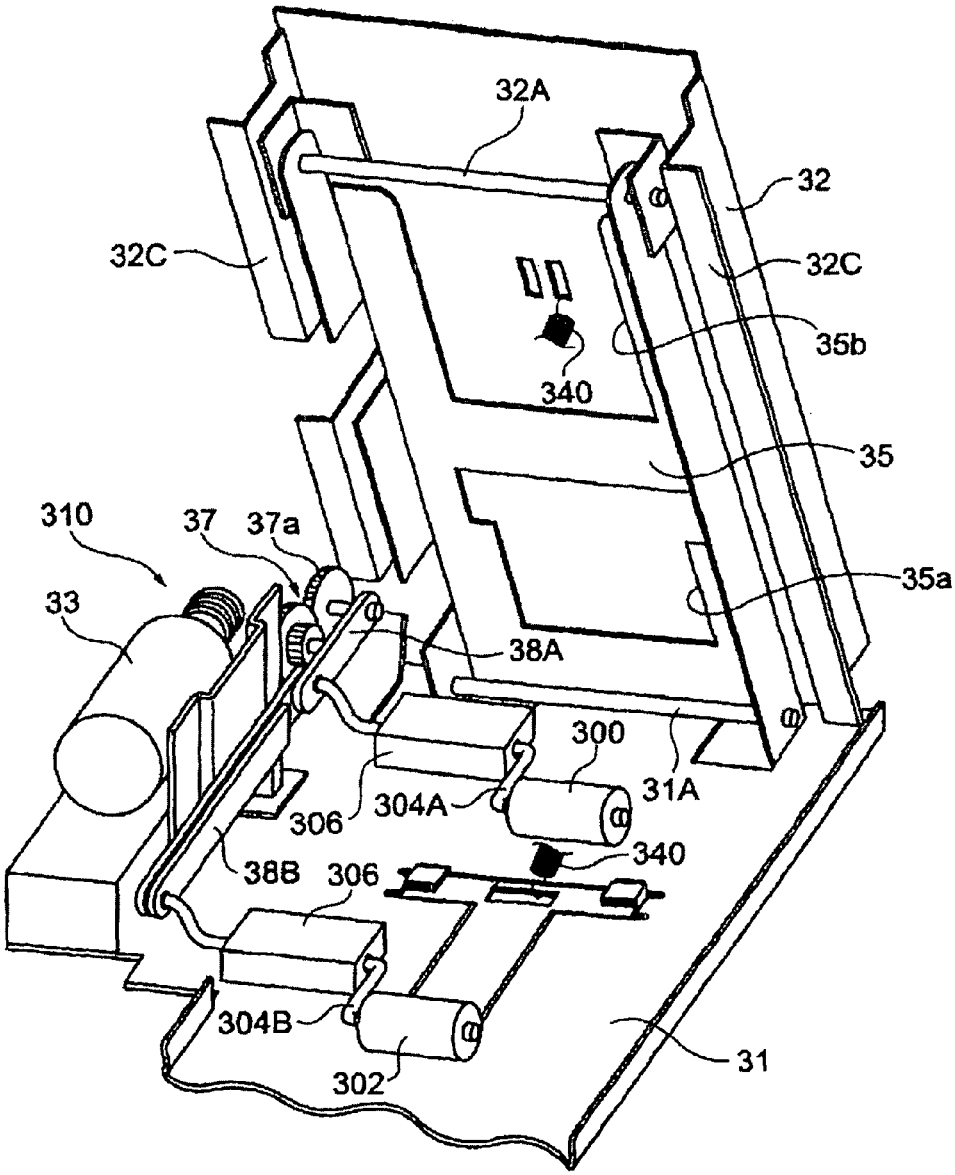
FIG. 6 is a view showing a structure of a bill press device, which shows a state in which a press plate is opened for a cover.
Figure 7:
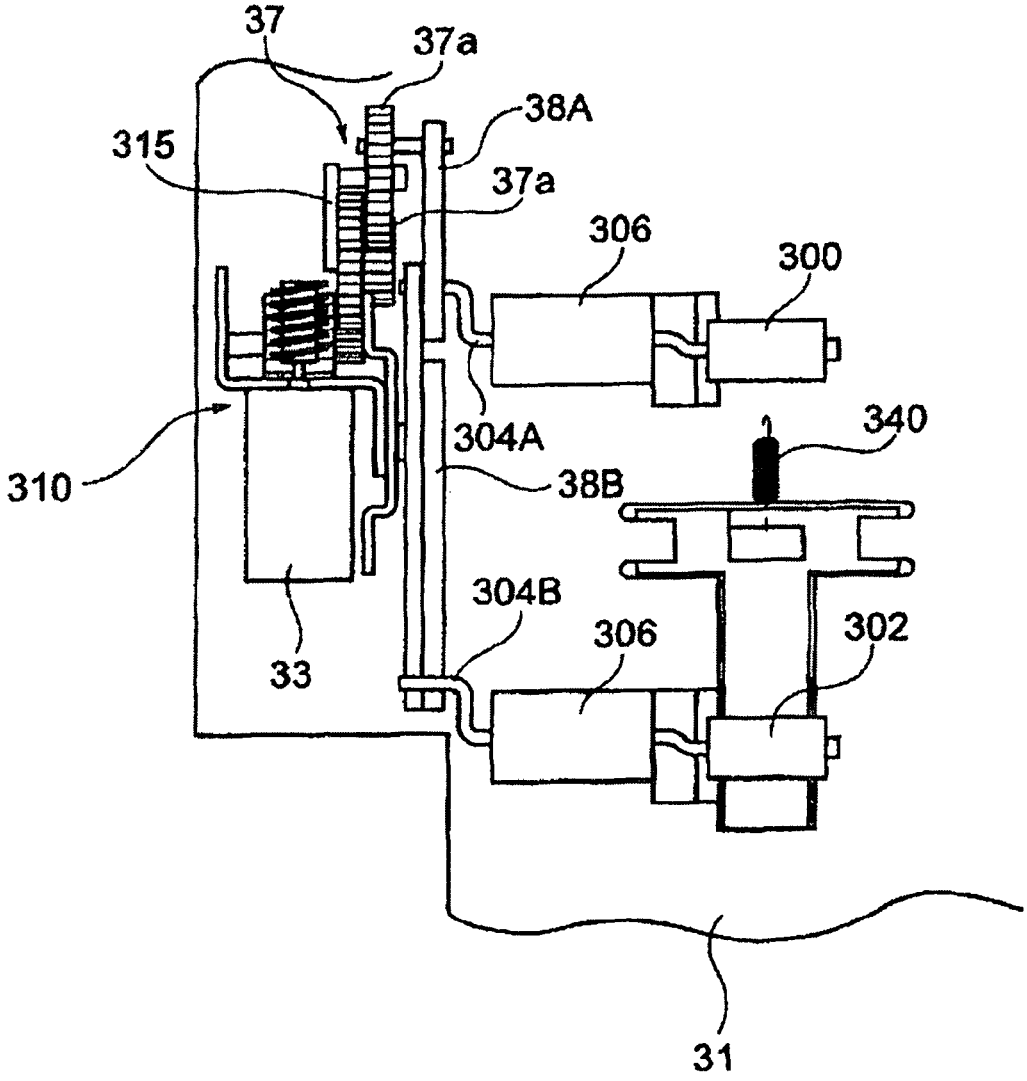
FIG. 7 is a view showing structures of a plate driving motor and a deceleration device.
Figure 8:
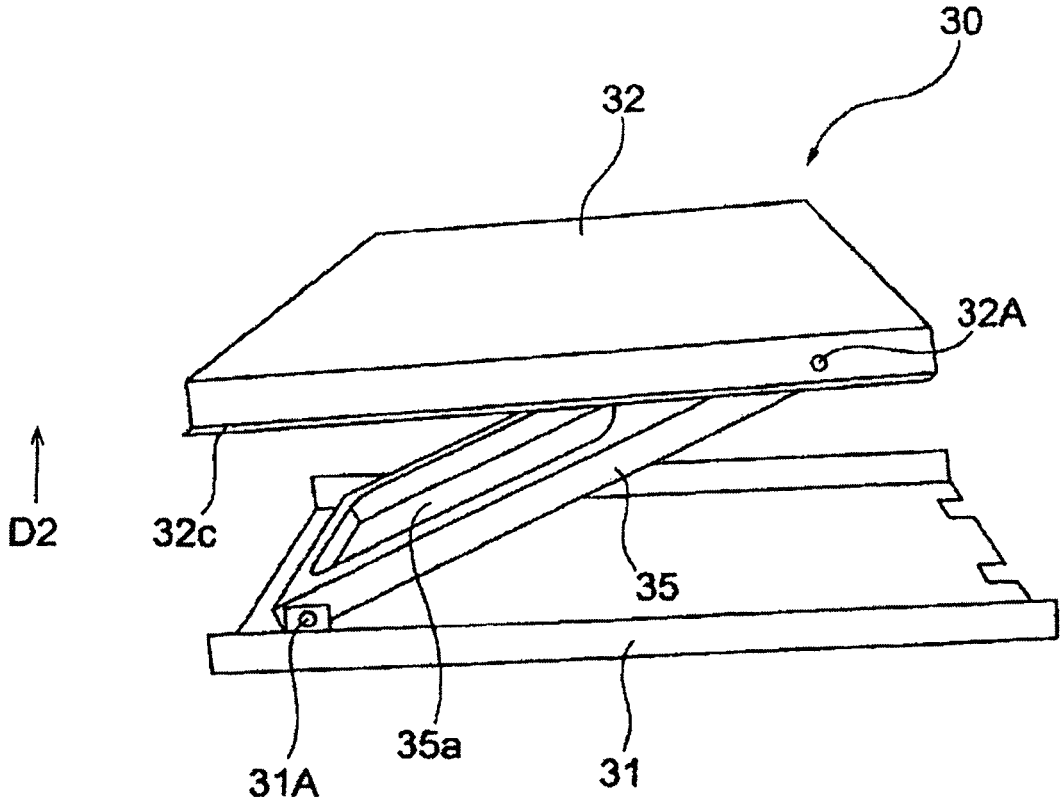
FIG. 8 is a view showing a structure of a connection device of a press plate for a cover.
Figure 9A:
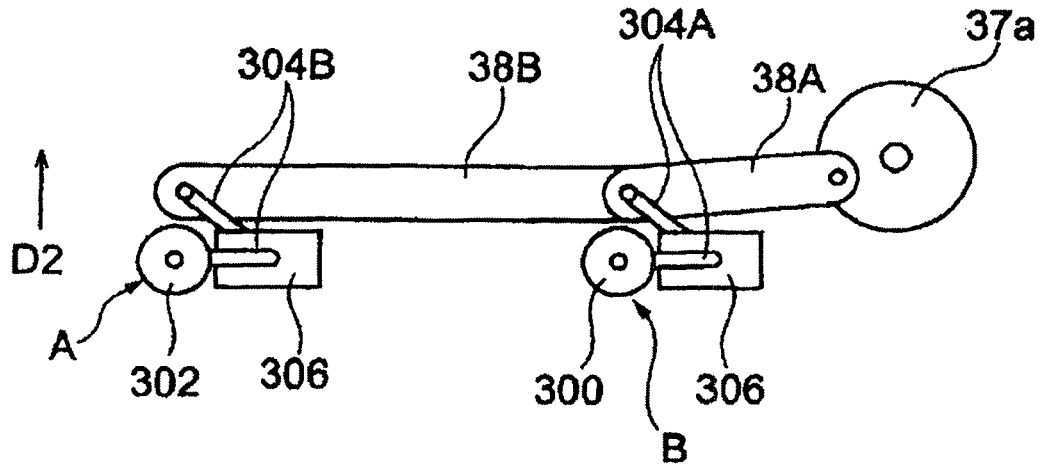
FIG. 9A is a side view showing an operating state of a bill press device, which shows a wait state in which a swing press member is laid down.
Figure 9B:
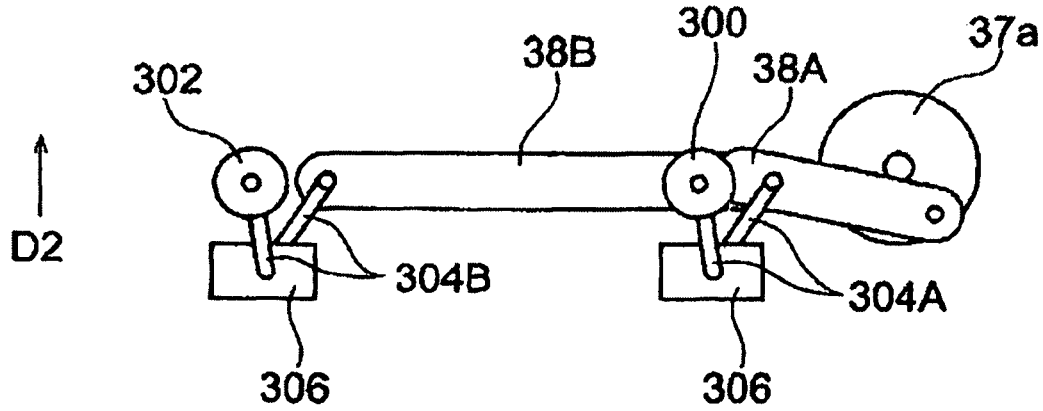
FIG. 9B is a side view showing an operating state of a bill press device, which shows a wait state in which a swing press member is raised.

In the followings, a structure of the bill press device 30 will be described with reference to FIGS. 6 to 9A and 9B. FIG. 6 shows a state in which the press plate 32 is opened for the cover 31, FIG. 7 is a view showing structures of a plate driving motor 33 and a deceleration device thereof, FIG. 8 is a view showing a structure of a connection device of the press plate 32 for the cover 31 (a control circuit substrate and the like are not shown), and FIGS. 9A and 9B show an operating state of the press plate in which FIG. 9A shows a non-pressed state and FIG. 9B shows a pressed state.

The press plate 32 has an approximate same size as the bill P and is supported so that it is moveable in the arrow direction D2 by a link plate 35 connecting a back surface of one end of the press plate 32 and a back surface of the other end of the cover 31. Both ends of the link plate 35 is pivotably supported through spindles 31A, 32A that are equipped to the cover 31 and the press plate 32. In the mean time, the press plate 32 is connected to the cover 31 by a compression spring 340 and is always biased toward the cover 31.

In addition, the bill press device 30 has a pair of first and second swing press members 300, 302 that move the press plate 32 toward the loading tray 60 (toward the D2 direction) while changing a position of a press operating point along the longitudinal direction of the press plate 32 due to its own swinging. To be more specific, the first and second swing press members 300, 302 are formed by cylindrical roller members and are connected to a swing driver 310 through corresponding first and second crankshafts 304A, 304B. The crankshafts 304A, 304B are rotatably supported by corresponding guide members 306 that are fixed to the cover 31.

The swing driver 310 has a plate driving motor 33. The plate driving motor 33 is provided to a back surface of the cover 31. In addition, a deceleration device (gear train) 37 that decelerates and transmits the rotation of the driving motor 33 to the crankshafts 304A, 304B is rotatably attached to the back surface of the cover 31 through a support plate 315. To a final gear 37*a* of the deceleration device 37 is pivotably connected one end of a first link arm 38A at a part offset from the center. In addition, to the other end of the first link arm 38A is attached the first crankshaft 304A that holds the first press member 300. Furthermore, to the other end of the first link arm 38A is pivotably connected one end of a second link arm 38B at a support point of the first crankshaft 304A. To the other end of the second link arm 38B is attached the second crankshaft 304B that holds the second press member 302.

Figure 10A:
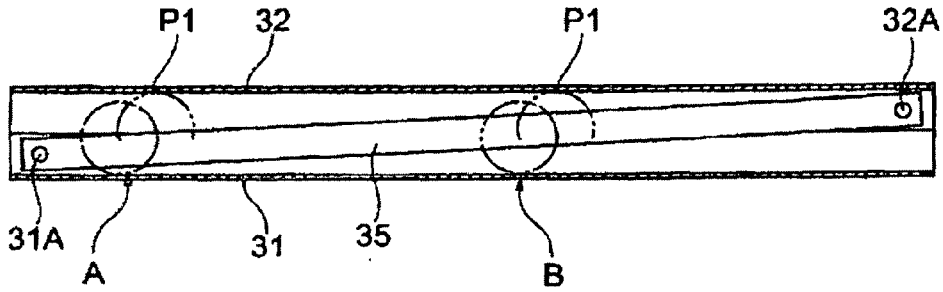
FIG. 10A is a schematic view showing an operation of a press plate, which shows a non-press state.
Figure 10B:
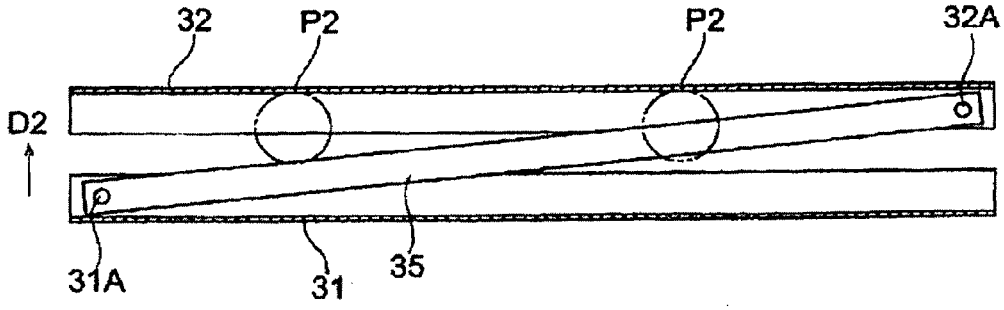
FIG. 10B is a schematic view showing an operation of a press plate, which shows a pressing state.
Figure 10C:
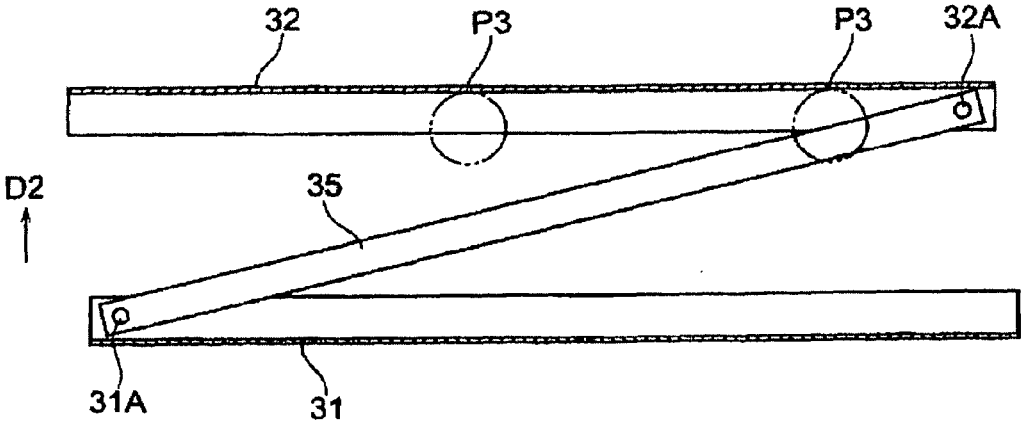
FIG. 10C is a schematic view showing an operation of a press plate, which shows a final press state.

Therefore, in such a structure, when the plate driving motor 33 is driven, the final gear 37A of the deceleration device 37 is rotated in a predetermined rotation speed, accompanying with the rotation driving of the deceleration device 37. Accompanying with this, the first and second link arms 38A, 38B are pivoted vertically and horizontally while forming a predetermined loop orbit, so that each of the swing press members 300, 302 is raised along an approximate semicircular path from a laid down position shown in FIG. 9A to a raised position shown in FIG. 9B. At this time, each of the swing press members 300, 302 contacts the press plate 32 through corresponding slit openings 35*a*, 35*b* of the link plate 35 so that it does not interfere with the movement of the link plate 35, thereby moving the press plate 32 toward the loading tray 60 (in the D2 direction). However, at this time, as shown in FIGS. 10A, 10B and 10C, the respective swing press members 300, 302 swing at two positions A, B spaced along a longitudinal direction of the press plate 32, thereby moving the press plate 32 toward the loading tray 60 while changing a position of the press operating point P for the press plate 32 along the longitudinal direction of the press plate 32 (the press operating point is gradually changed to P1→P2→P3). In other words, the swing press members 300, 302 press the press plate 32 at one side thereof toward the loading tray 60 (the bill P is moved toward the loading tray 60 at one side of the press plate 32) and then press the press plate toward the loading tray 60 at the other side thereof (accordingly, the bill P is moved toward the loading tray 60 at the other side of the press plate 32).

As can be seen from the above structure, in this embodiment, during the half-rotation of the final gear 37*a*, the respective swing press members 300, 302 are raised to the raised position shown in FIG. 9B from the laid down position shown in FIG. 9A. When the final gear 37*a* is further half-rotated, the respective swing press members 300, 302 are laid down to the laid down position shown in FIG. 9A from the raised position shown in FIG. 9B. In other words, while the final gear 37*a* is rotated, the respective swing press members 300, 302 are reciprocally swung one time, so that the press plate 32 is reciprocally driven in the D2 direction (moved between a bill press position (position in FIG. 10C) and a wait position (position in FIG. 10A)).

In the mean time, in the above structure, the press operating point is continuously changed due to the swinging of the respective swing press members 300, 302 along the longitudinal direction of the press plate. However, in an alternative embodiment, after the press plate 32 is pressed at one side thereof toward the loading tray 60 by a first press member, the press plate 32 may be pressed at the other side thereof toward the loading tray 60 by a second press member. In this case, the press operating point is not continuously changed along the longitudinal direction of the press plate 32 and the pressing force is applied to the press plate 32 at two separate operating points by making the press timings different.

In addition, the press plate 32 has such a shape that it vertically extends toward the pressing direction by a predetermined length and both lengthwise sides of the press plate 32 are formed with flanges 32*c*. Thereby, when the press plate 32 is pressed by the respective swing press members 300, 302, it is introduced into an opening of the loading tray 60, which will be described later. When the press plate 32 is introduced into the opening to some extent, both flanges 32*c* are contacted to engagement portions 61*c* of the loading tray 60, which will be described later, so that the press plate 32 is not further introduced. In other words, by providing the flanges 32*c*, the press plate 32 can apply to the bill P the pressing force uniform in the longitudinal direction even though it is supported at one side by the link plate 35.

In the bill press area 10, the loading tray 60 is provided to the other side of the cabinet 1*a*, as shown in FIGS. 2 and 3. The loading tray 60 is structured to sequentially stack and receive the bills P pressed by the press plate 32. In the followings, a structure of the loading tray 60 will be described with reference to FIGS. 11A, 11B, 12A, 12B and 12C.

Figure 11A:
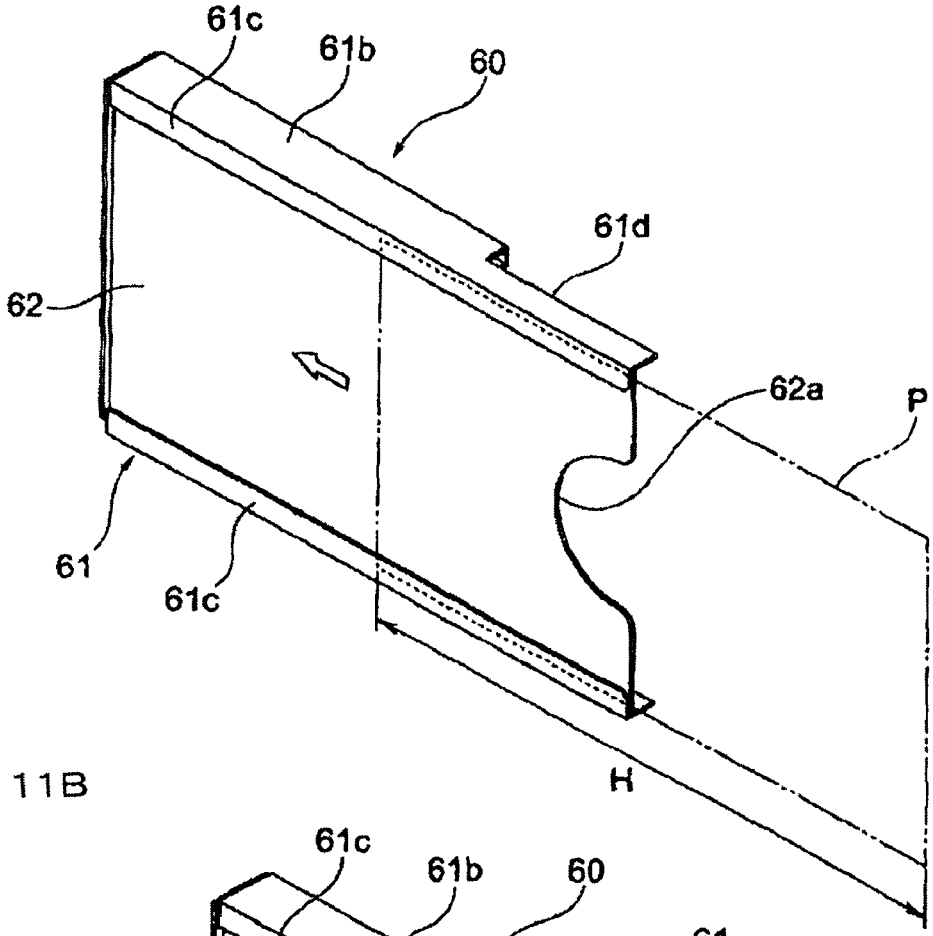
FIG. 11A is a perspective view showing a structure of a loading tray, which shows a state in which bill is discharged to a bill press area.
Figure 11B:
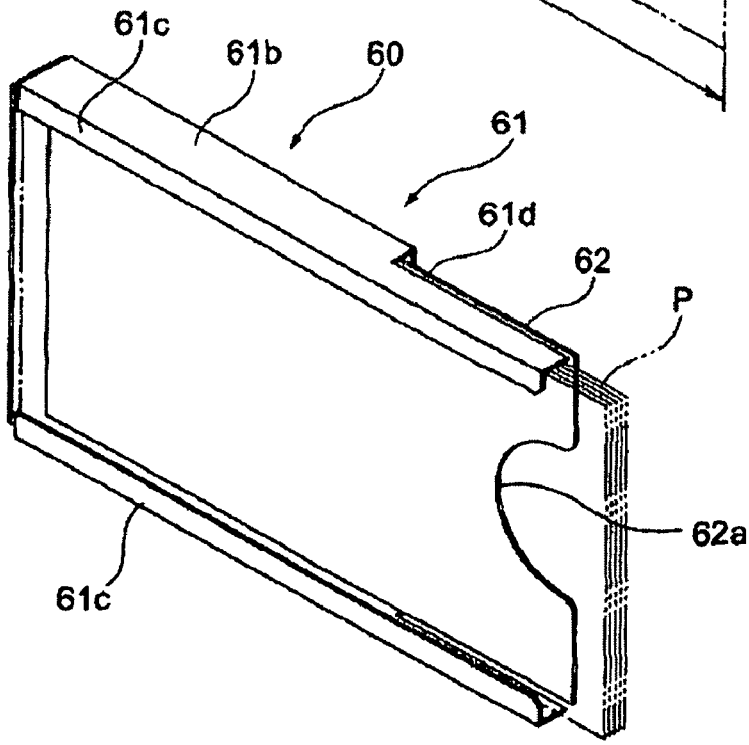
FIG. 11B is a perspective view showing a structure of a loading tray, which shows a state in which bill is stacked and received.
Figure 12A:
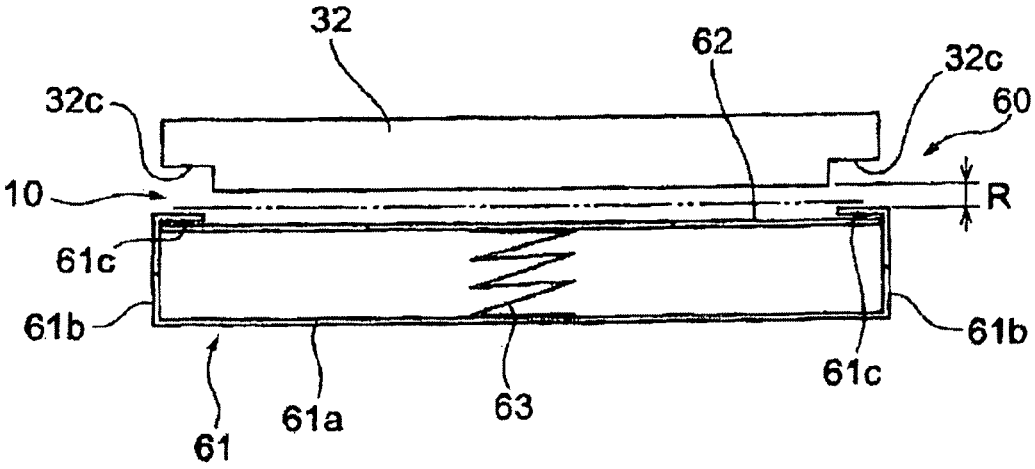
FIG. 12A illustrates a bill press state by a press plate to a loading tray, which shows a state before the press.
Figure 12B:
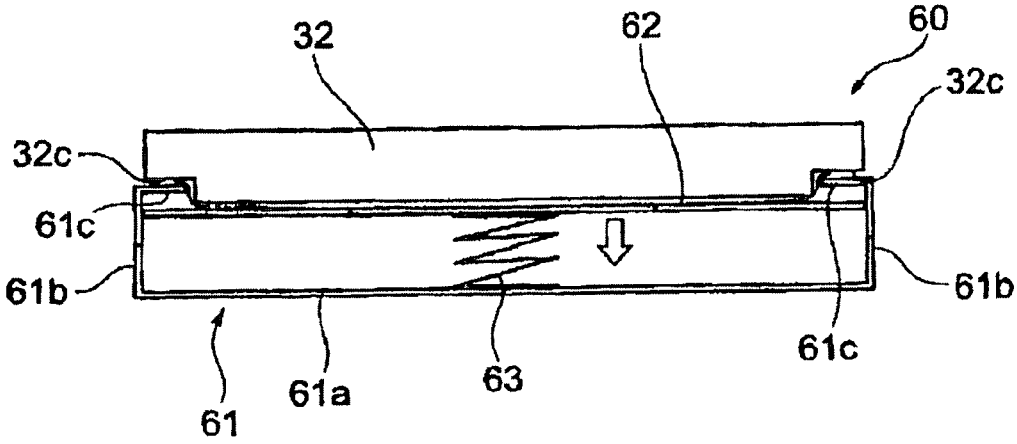
FIG. 12B illustrates a bill press state by a press plate to a loading tray, which shows a pressing state.
Figure 12C:
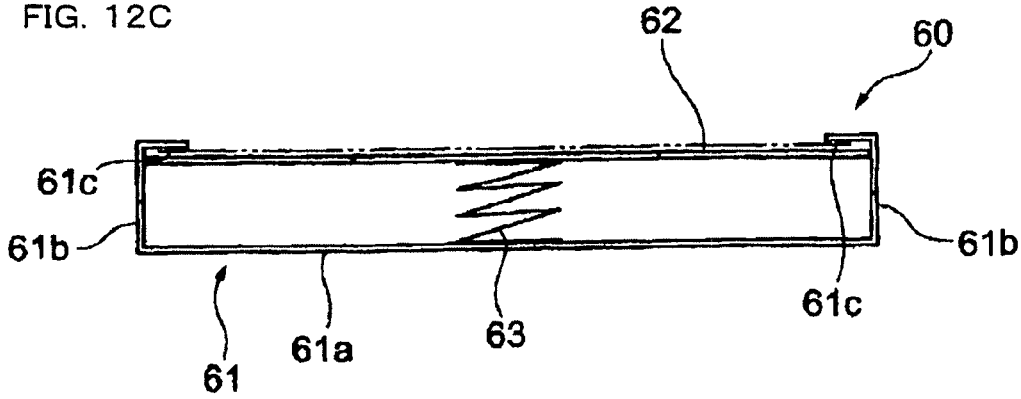
FIG. 12C illustrates a bill press state by a press plate to a loading tray, which shows a state after the press.

The loading tray 60 has a main body 61 having a bottom wall 61*a* and sidewalls 61*b* formed at both sides of the bottom wall 61*a*. A loading plate 62 on which a bundle of bills is put is provided between the sidewalls 61*b* of the main body 61. The loading plate 62 is press-biased by a biasing spring 63 that is provided between the loading plate 62 and the bottom wall 61*a* of the main body 61. In addition, a pair of engagement portions 61*c* extending along the longitudinal direction of the bill P is formed at opening ends of the sidewalls 61*b*. As shown in FIGS. 11A and 12A, the engagement portions 61*c* have a function of dividing the bill P discharged in the bill press area 10 and the bill bundle received in the main body 61. In other words, when the bill P discharged in the bill press area 10 is pressed by the press plate 32, the bill P is delivered on the loading plate 62 while being bent at its center due to the engagement portions 61*c*, as shown in FIG. 12B. In addition, when the bill P overrides the engagement portions 61*c*, the bill P is stacked on the loading plate 62 against the biasing force of the biasing spring 63, as shown in FIGS. 11B and 12C. Then, when the press plate 32 is returned to its initial position, the bill bundle stacked on the loading plate 62 is bumped into the engagement portions 61*c* at its both ends due to the biasing force of the biasing spring 63.

Thereby, a gap R is formed between the uppermost bill P stacked on the loading tray 60 and the press plate 32, as shown in FIG. 12A, so that a sorting is made. In other words, the bill P discharged through the bill delivery device 7 is put into the gap R, in which the bills P put therein are sequentially stacked on the loading tray 60 by the driving of the press plate 32 of the initial position.

In the mean time, if the gap R is exceedingly wide, it may cause a jam when there is a wrinkle in the bill P, for example. If the gap R is exceedingly narrow, the bill P cannot be stably delivered and introduced therein. To be more specific, a preferred gap is about 3~5 mm and it is preferred to dispose the bill press device 30 and the loading tray 60 so that the gap is formed.

The bill P stacked in the main body 61 of the loading tray 60 is maintained by means of the press plate 62 press-biased and the engagement portions 61*c*. By the structure, the front ends of the bill bundle are exposed. Due to this, when the loading tray 60 is driven and the front end thereof is thus protruded from the front face 1*b* of the cabinet 1*a*, the leading ends of the bill bundle stacked on the loading plate 62 are exposed, so that an operator can easily draw out the bill bundle to collect it.

In this case, a longitudinal length (length of a bill stack surface) of the main body 61 (the loading plate 62) is preferably shorter than the length of the bill P to be inserted. Like this, the length of the loading plate 62 is shortened, so that the bill bundle received therein is exposed at the leading end of the upper surface and the lending end of the lower surface. Therefore, an operator can easily pick out the bill bundle. In addition, due to such structure, an operator can safely perform a collection operation without making a finger contact the loading plate 62 made of metal, for example SUS. Alternatively, as shown in FIGS. 11A and 11B, a recess 62*a* may be formed at a center of a leading edge of the loading plate 62. Even in such structure, the bill bundle can be easily caught, so that the above effects can be achieved.

In the mean time, in the leading ends of both sidewalls 61*b* of the main body 61, slit portions 61*d* are formed at sides of the cabinet 1*a*, which extend in the bill insertion direction over a predetermined range. By forming the slit portions 61*d*, a shield plate 91 is opened by means of a shield plate opening/shutting device that will be described later. In addition, when the loading tray 60 is driven in a protrusion direction, the opened shield plate 91 and the main body 61 are not interfered, so that it is possible to effectively use a space. Furthermore, the loading tray 60 may be provided with a bill detection sensor 128 (refer to a block diagram in FIG. 17) for detecting whether the bill P is present on the loading plate 62.

Figure 13:
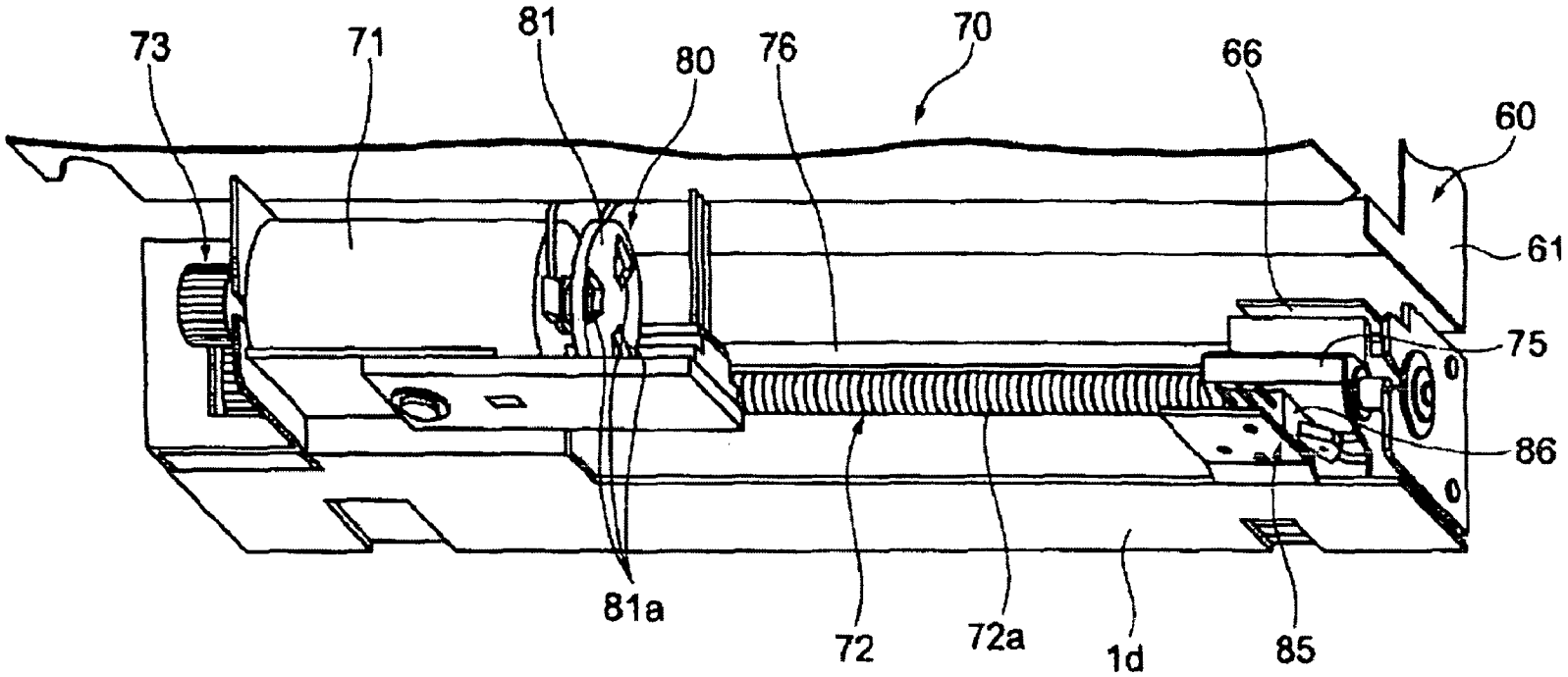
FIG. 13 shows a structure of a loading tray driving device.

In the followings, a movement device 70 for moving the loading tray 60 toward the bill collection slot 3B will be described with reference to FIGS. 3 and 13.

A movement device 70 is provided to move the loading tray 60 between a bill receiving position (position shown in FIGS. 4 and 5) for receiving the bill P in the loading tray 60 and a bill collection position (position shown in FIGS. 24 and 25) at which the loading tray 60 is protruded from the bill collection slot 3B, and comprises a tray driving motor 71 fixed in the inner frame 1*d* of the cabinet 1*a* and a driving shaft (warm shaft) 72 that is rotated by the tray driving motor 71. The driving shaft 72 is extended in the bill insertion direction so that it is rotatably supported in the inner frame 1*d*, and has a male screw 72*a* formed at its outer periphery. In addition, one end of the driving shaft 72 is connected to an output axis of the tray driving motor 71 through a gear train 73.

To a rear end of the main body 61 of the loading tray 60 is formed a connection piece 66 to which a sliding movement member 75 is connected which is disposed to surround the driving shaft 72. The sliding movement member 75 is formed with a female screw (not shown) that is screw-engaged with the male screw 72*a* of the driving shaft 72. As the driving shaft 72 is rotated, the sliding movement member 75, i.e., loading tray 60 is reciprocally moved along an axial direction. In this case, the sliding movement member 75 is inserted into a guide rod 76 that is disposed in parallel with the driving shaft 72. When the sliding movement member 75 is reciprocally moved, the rotation is not made.

The movement device 70 is provided with a movement amount detection unit 80 that is capable of detecting a movement amount of the loading tray 60. The movement amount detection unit 80 may comprise a disc-shaped rotator 81 provided to a portion protruded in a direction opposite to an output axis of the tray driving motor 71 and a rotation amount detection sensor (optic sensor) 82 that is disposed to hold the rotator 81 while interposing a gap therebetween. The rotator 81 is formed with encoders 81*a* (openings formed at a distance along a circumferential direction). When the encoders 81*a* are rotated as the tray driving motor 71 is rotated, the rotation amount detection sensor 82 can obtain a pulse resulting from the rotation amount and can detect a movement amount of the loading tray 60 in accordance with the number of pulses.

By providing the movement amount detection unit 80, it is possible to precisely control a stop position of the protrusion direction of the loading tray 60 and to reduce the load for the tray driving motor 71.

In addition, the movement device 70 is further provided with a position detection unit 85 that is capable of detecting a receiving position (position capable of receiving the bill P) of the loading tray 60. The position detection unit 85 may be such structured that an engagement piece (not shown) is provided to the sliding movement member 75 driving the loading tray 60 and a limit switch 86 is mounted in the inner frame 1*d*, which is turned on/off as the engagement piece is contacted/released.

By providing the position detection unit 85, it is possible to determine the state of the loading tray 60 (whether the loading tray is at the receiving position or the collection position) and to appropriately drive the loading tray 60 when performing a bill collection operation.

Figure 25:
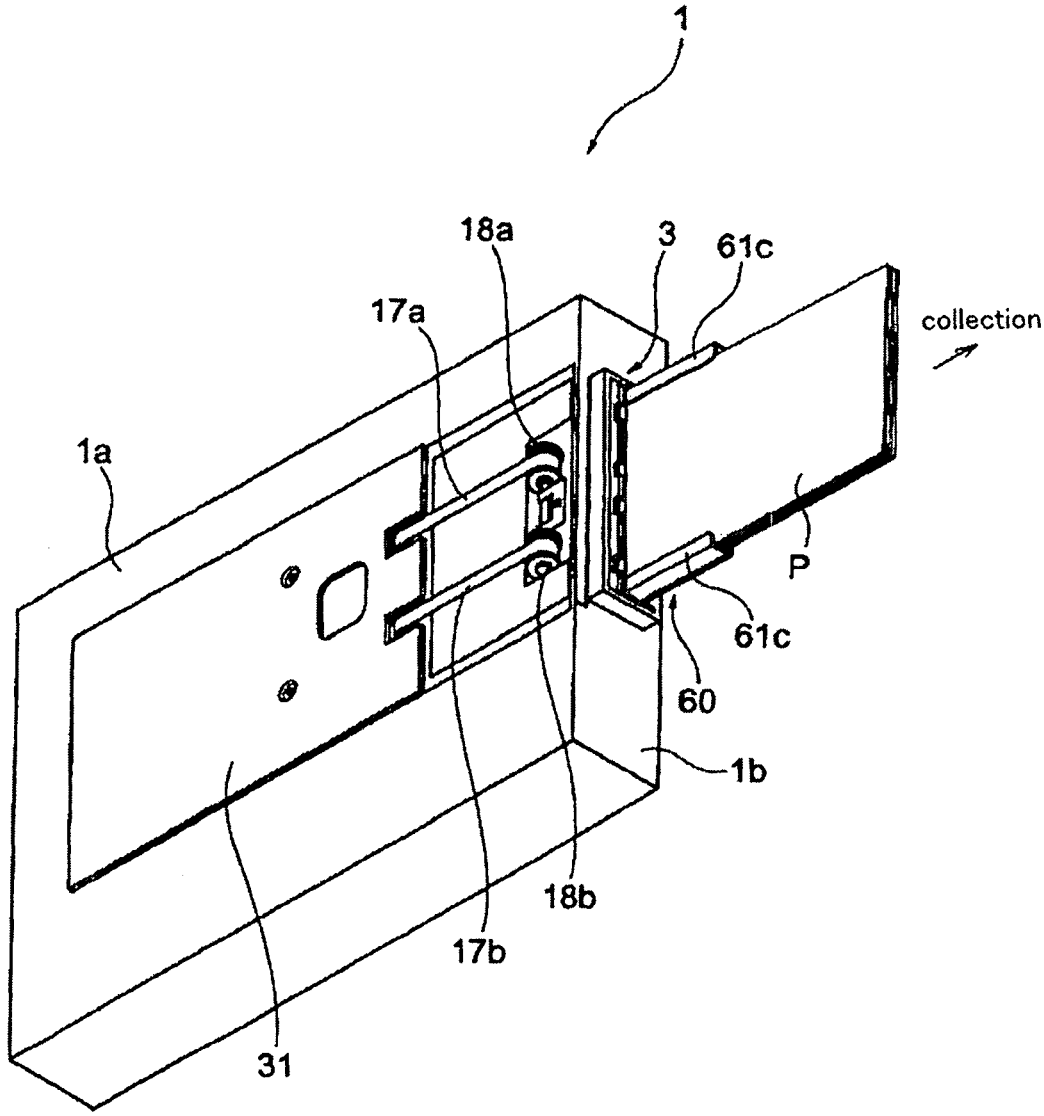
FIG. 25 shows a state in which a loading tray is discharged.

In addition, the bill P received in the loading tray 60 can be collected by moving the loading tray 60 toward the bill collection slot 3B by the movement device 70 and protruding the loading tray 60 to an outside through the bill collection slot 3B opened due to the opening operation of the shield plate 91 (refer to FIG. 25). In the followings, an opening/shutting device 150 that opens/shuts the shield plate 91 and a lock device 400 that locks the shut state of the shield plate 91 to be released.

A lock device 400 that locks the shut state of the shield plate 91 to be released will be firstly described with reference to FIGS. 4 and 5.

In this embodiment, the lock device 400 is adapted to mechanically operate in connection with the movement of the loading tray 60 that is moved by the movement device 70. In particular, in this embodiment, the lock device 400 is adapted to contact the loading tray 60 that is moved toward the bill collection slot 3B by the movement device 70, thereby releasing the lock of the shield plate 91 shut. To be more specific, the lock device 400 has a pair of pivot members 402 at both sides of the movement path of the loading tray 60 (that is moved by the movement device 70), which members are pivoted between a lock position (position shown in FIGS. 4 and 5), at which the lock device is opposite to the shield plate 91 to obstruct the shield plate from being opened, and a lock release position (position shown in FIGS. 23 and 24), at which the lock device retreats from the shield plate 91 to allow the shield plate 91 to be opened. The pivot members 402 are disposed between the loading tray 60 that is at the bill receiving position (position shown in FIGS. 4 and 5) and the shield plate 91, comprise a main body part 402*a* that is pivotable about a spindle 430 fixed to the inner frame 1*d*, a contact part 402*b* that is formed at a front end of the main body part 402*a* and contacts the shield plate 91 at the lock position and a first interlocking operation part 402*c* that is protruded into the movement path of the loading tray 60 and serves as a block part, and are adapted to pivot from the lock position to the lock release position as the loading tray 60 to be moved toward the bill collection slot 3B by the movement device 70 is contacted to the first interlocking operation part 402*c*.

In addition, a biasing spring (biasing member) 411 is wound around the spindle 430, which spring has one end fixed to the inner frame 1*d* and the other end fixed to the pivot members 402. The biasing spring 411 biases the pivot members 402 toward the lock position.

Furthermore, in this embodiment, the loading tray 60 is provided with a lock release prevention unit that is engaged with the lock device 400 at the bill receiving position to prevent the lock of the shield plate 91 shut from being released. To be more specific, the lock release prevention unit is formed by front end faces 61*b*' of the sidewalls 61*b* of the main body 61 of the loading tray 60 that contacts protrusion pieces 402*d* of rear ends of the pivot members 402 extending toward the loading tray 60, at the bill receiving position.

Figure 14:
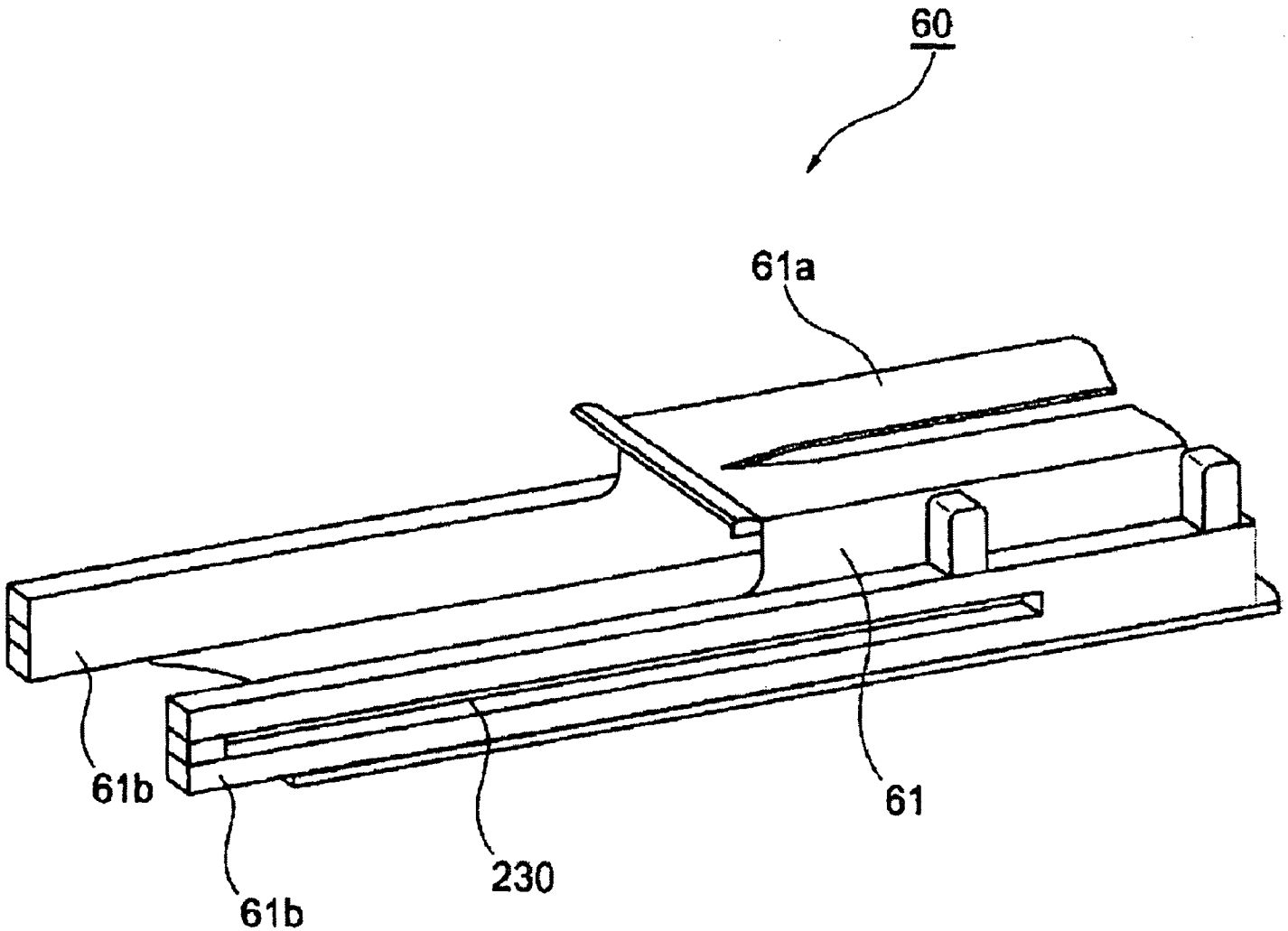
FIG. 14 is a perspective view of a loading tray.

Additionally, in this embodiment, the loading tray 60 is provided with a prevention release unit that releases the lock release prevention state by the lock release prevention unit, accompanying with the movement of the loading tray 60 toward the bill collection slot 3B by the movement device 70. To be more specific, as shown in FIG. 14, the prevention release unit consists of elongated grooves 230 that are formed along the sidewalls 61*b* of the main body 61 of the loading tray 60. When the loading tray 60 is moved toward the bill collection slot 3B by the movement device 70, the elongated grooves 230 receives to release the protrusion pieces 402*d* of rear ends of the pivot members 402 therein, thereby releasing the contact state between the front end faces 61*b*' of the loading tray 60 and the protrusion pieces 402*d* of the pivot members 402 and thus allowing the pivot members 402 to be pivoted to the lock release position.

In the followings, an opening/shutting device 150 that opens/shuts the shield plate 91 will be described.

In this embodiment, the opening/shutting device 150 is adapted to mechanically operate in connection with the movement of the loading tray 60 that is moved by the movement device 70. In particular, in this embodiment, the opening/shutting device 150 is adapted to contact the loading tray 60, which is moved toward the bill collection slot 3B under state that the lock of the shield plate 91 shut is released, thereby opening the shield plate 91. Specifically, the opening/shutting device 150 is provided to be adjacent to the shield plate 91 to one side of the movement path of the loading tray 60 and comprises a cylindrical rotation member 150A which has a second interlocking operation part 153 protruding into the movement path of the loading tray 60, and a gear device 150B that is engaged with the rotation member 150A and converts rotation force of the rotation member 150A into an opening/shutting operation of the shield plate 91. In this case, the rotation member 150A has a gear part 154 at an end opposite to the second interlocking operation part 153. The gear part 154 is engaged with a gear train 159 of the gear device 150B. In addition, a final gear 159*a* of the gear train 159 is fixed to a rotation axis (pivot axis of the opening/shutting operation of the shield plate 91) of the shield plate 91. Accordingly, when the rotation member 150A is rotated, the shield plate 91 is opened/shut through the gear device 150B.

In addition, in this embodiment, the second interlocking operation part 153 of the rotation member 150A has a shape and a position set so that it contacts the loading tray 60 moving toward the bill collection slot 3B by the movement device 70 to override the sidewalls 61*b* of the loading tray 60, thereby rotating the rotation member 150A in one direction (in this embodiment, a direction to which the shield plate 91 is opened). The second interlocking operation part 153 is adapted to maintain the state in which it overrides the sidewalls 61*b* of the loading tray 60 during the movement of the loading tray 60, thereby keeping the rotated state of the rotation member 150A. In other words, it can be said that the upper faces of the sidewalls 61*b* of the loading tray 60 constitute an opening maintain unit that supports the second interlocking operation part 153 from the bottom and maintains the opened state of the shield plate 91 after contacting the second interlocking operation part 153.

Additionally, in this embodiment, a spring 160 is inserted between the rotation member 150A and the inner frame 1*d*, which serves as a biasing member that biases the rotation member 150A in a direction (in this embodiment, a direction to which the shield plate 91 is shut) opposite to the one direction.

In the mean time, in the above structure, the shield plate 91 is opened/shut as the opening/shutting device 150 is mechanically operated in connection with the movement of the loading tray 60 due to the movement device 70. However, it may be possible that the shield plate 91 contacts the loading tray 60, which is moved toward the bill collection slot 3B by the movement device 70 under state that the lock of the shield plate 91 shut is released by means of the lock device 400, thereby opening the bill collection slot 3B. In this case, the opening/shutting device 150 is not required.

Figure 26A:
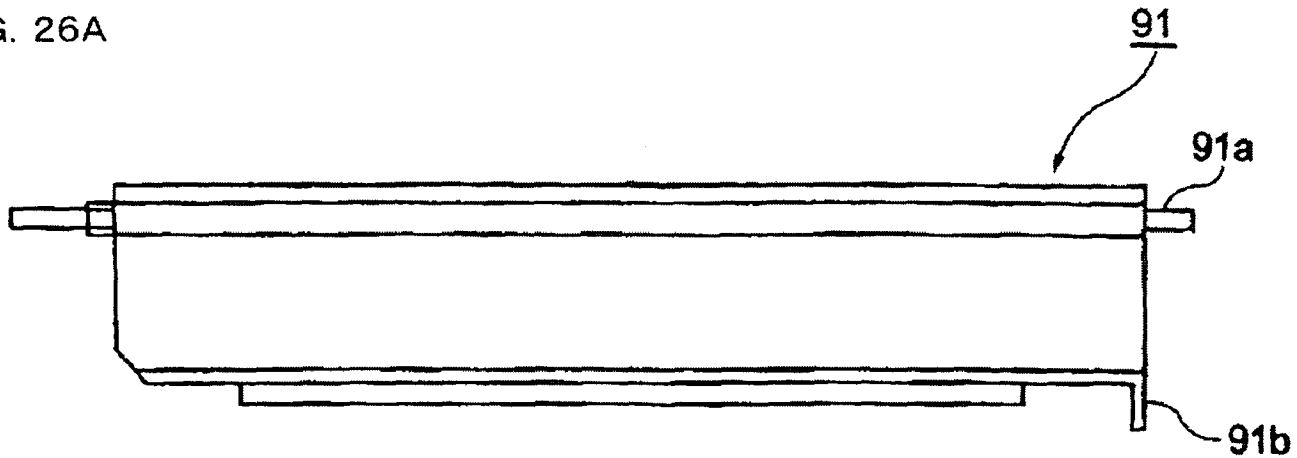
FIG. 26A shows a structure of a detection member that detects an opening/shutting state of a shield plate.
Figure 26B:
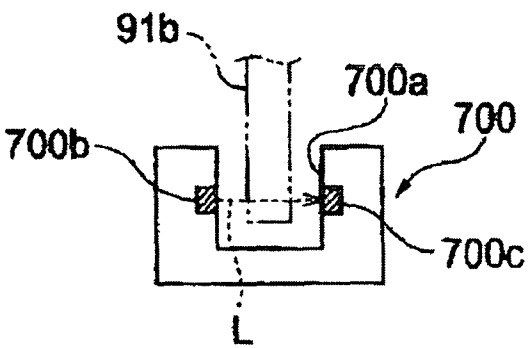
FIG. 26B shows a structure of a detection member that detects an opening/shutting state of a shield plate.

In addition, in the above structure, in order to increase the safety of the apparatus, it is provided a detection member that detects an opened/shut state of the shield plate 91. To be more specific, as shown in FIGS. 26A and 26B, the detection member consists of a detection piece 91*b* of a protrusion type that is formed at an end edge opposite to a pivot axis 91*a* that is a central axis of an opening/shutting operation of the shield plate 91, and a shield plate opening/shutting detection sensor 700 that has a receiving recessed portion 700*a* that is provided to the main body of the apparatus and receives the detection piece 91*b* when the shield plate 91 is opened. The detection sensor 700 consists of a transmissive optic sensor. A CPU 130 (refer to FIG. 17) recognizes the shut state of the shield plate 91 as the light L, which traverses a space of the receiving recessed portion 700*a* toward a light receiving part 700*c* from a light emitting part 700*b*, is shielded by the detection piece 91*b* of the shield plate 91, which is received in the receiving recessed portion 700*a*. In this case, when the CPU 130 recognizes an opened state (a state in which the light L traversing the space of the recessed portion 700*a* is not shielded by the detection piece 91*b* of the shield plate 91) of the shield plate 91 under inappropriate state, a warning such as alarming is preferably made. Typically, the shield plate 91 is such structured that it is not opened from an outside. However, after an operation of collecting the bill bundle in the loading tray 60 is performed, the shield plate 91 may be left as it is opened when the loading tray 60 is not operated. In such a case, the loading tray 60 located in the shield plate 91 may be recognized from an outside. Due to this, when the detection member detecting an opened/shut state of the shield plate 91 is provided as in the above structure, it is possible to always monitor an opened/shut state of the shield plate 91 by means of the CPU 130, so that a security performance of the apparatus is increased.

In addition, the bill processing apparatus 1 of the embodiment is provided with a shutter device 500 that blocks the bill insertion slot 3A to prevent the bill from being further inserted when the bill P inserted from the bill insertion slot 3A is delivered by means of the bill delivery passage. In the followings, the shutter device 500 will be specifically described.

Figure 15:
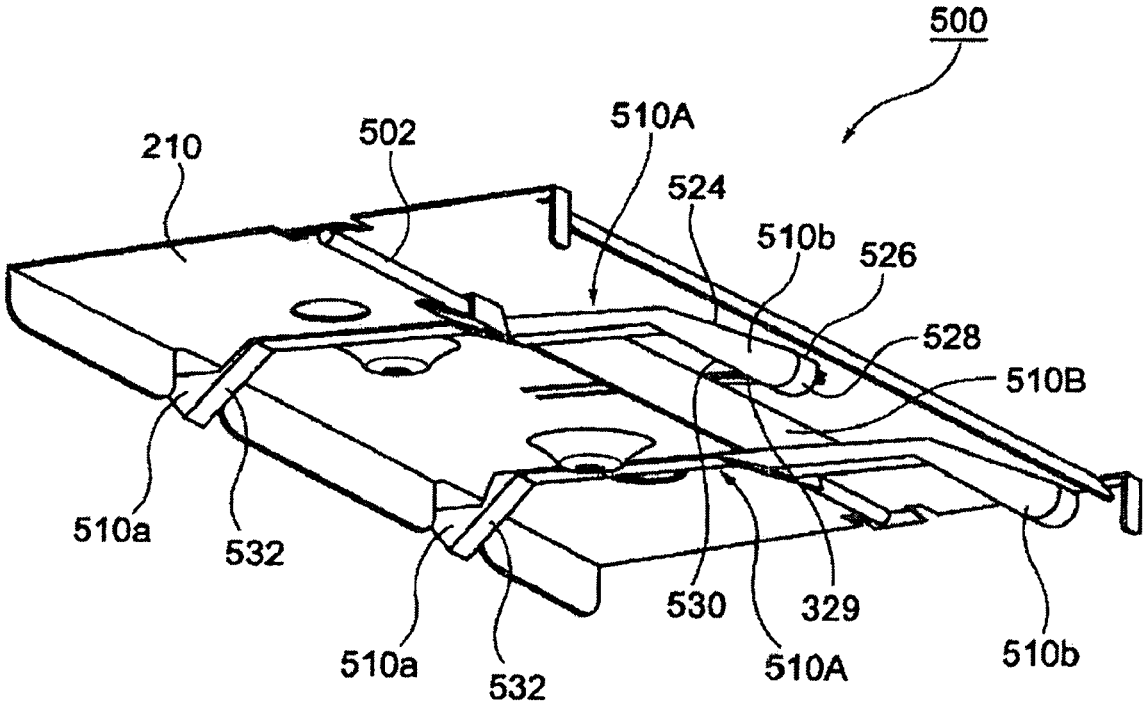
FIG. 15 is a perspective view of a shutter device.
Figure 16A:
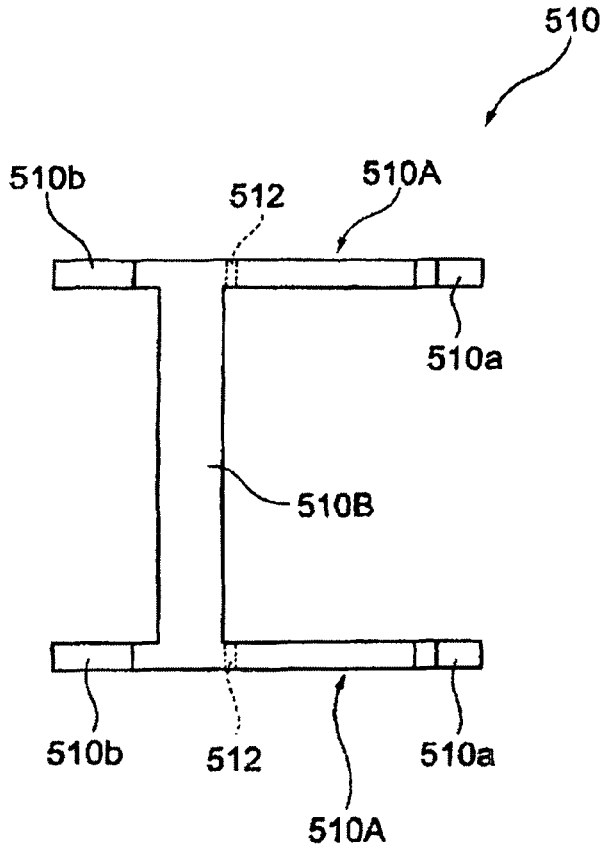
FIG. 16A is a plan view of a swinging member constituting a shutter device.
Figure 16B:
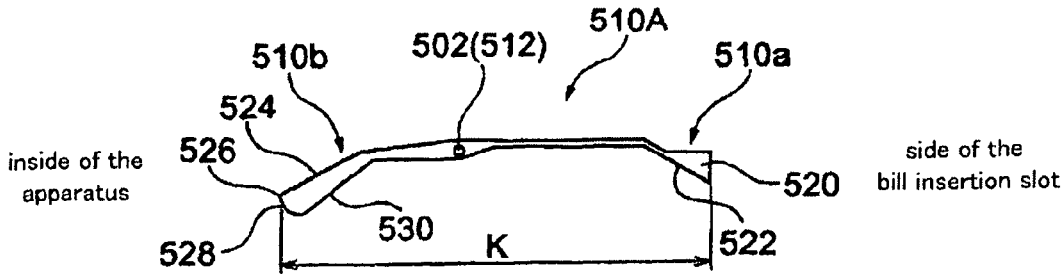
FIG. 16B is a side view of a swinging part.
Figure 18B:
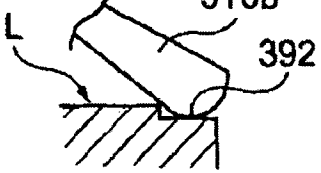
FIG. 18B shows a delivery operation of introducing bill in a press area through a bill insertion slot.

As shown in FIGS. 18A and 18B, the shutter device 500 is disposed opposite to the bill delivery passage L (bill delivery surface) and has a plate-type support member 210 (refer to FIGS. 4 and 5; the bill delivery passage L is provided to a back surface of the movement path of the loading tray 60 shown in FIG. 4) that is detachably attached to the inner frame 1*d*. As clearly shown in FIGS. 15, 16A and 16B, a swinging member 510 is swingably supported to the support member 210 by means of a spindle 502. The swinging member 510 is formed with resin, for example, and consists of a pair of swinging parts 510A, 510A located at both sides of the bill delivery passage L and a connection part 510B that connects the swinging parts 510A, 510A. In addition, each of the swinging part 510A, 510A is formed with a through-hole 512 through which the spindle 502 passes.

Each of the swinging parts 510A, 510A has a first end 510*a* that is provided at one side regarding the spindle 502 (a side near to the bill insertion slot 3A) and is capable of blocking the bill insertion slot 3A and a second end 510*b* that is provided at the other side regarding the spindle 502 (a side far from the bill insertion slot 3A) and is capable of blocking the bill delivery passage L. The first end 510*a* is adapted to block the bill insertion slot 3A by a swinging operation through the spindle 502, which accompanies with the contact between the bill P delivered by the bill delivery passage L and the second end 510*b*. To be more specific, the first and second ends 510*a*, 510*b* are bent toward the bill delivery passage L (bill delivery surface). When the bill P inserted from the bill insertion slot 3A is introduced between the second end 510*b* and the bill delivery surface, the second end 510*b* is lifted up and the swinging member 510 is thus swung about the spindle 502, so that the first end 510*a* is lifted down and the bill insertion slot 3A is thus blocked (a state shown in FIG. 19). Thereby, in the bill insertion slot 3A, new bill P is prevented from being inserted into the main body of the apparatus.

In addition, in this embodiment, as shown in FIGS. 18A and 18B, the second end 510*b* of each of the swinging parts 510A, 510A is adapted to contact the other side of the bill delivery passage L so that a gap S of about one bill is formed between the first end 510*a* and the bill delivery passage (delivery surface of the bill delivery passage L) under non-contact state with the bill, thereby blocking the bill delivery passage L.

In the mean time, the support member 210 is provided with a biasing member that always biases the swinging member 510 in a direction of contacting the second end 510*b* to the bill delivery passage L. In this embodiment, the biasing member is formed by cutting up the support member 210 and is also formed by an elastic piece 329 contacting the connection part 510B of the swinging member 510 (refer to FIGS. 4 and 15).

In addition, in this embodiment, each of the swinging parts 510A, 510A (swinging member 510) is such set that a length K (refer to FIG. 16B) between the first end 510*a* and the second end 510*b* is shorter than a length H (refer to FIG. 11A) of the bill P in a delivery direction and it is deformable by contact with the bill P. In order to achieve the deformation, the entire swinging member 510 may be formed with an elastic member or each of the swinging parts 510A, 510A may be formed with a groove or recessed portion for ease bending. However, in this embodiment, a portion of the swinging part 510A between the spindle 502 and the first end 510*a* is provided with an area that is thinner than a portion of the swinging part 510A between the spindle 502 and the second end 510*b*. Particularly, in this embodiment, a portion of the swinging part 510A between the spindle 502 and the first end 510*a* is thinner than a portion of the swinging part 510A between the spindle 502 and the second end 510*b* (refer to FIG. 16B).

Furthermore, in this embodiment, the first end 510*a* of the swinging part 510A has a reinforcing protrusion 520 that protrudes toward the bill insertion slot 3A. In addition, the first end 510*a* is formed, at a part opposite to a part facing on the bill insertion slot 3A, with an inclined surface 522 that is inclined toward the bill delivery passage L.

In addition, in this embodiment, the second end 510*b* of the swinging part 510A is formed, at a part opposite to a part facing on the bill insertion slot 3A, with an inclined surface 524 that is inclined to deviate from the bill delivery passage L. In addition, the second end 510*b* has a protrusion 526 that protrudes toward an opposite side of the bill insertion slot 3A. Furthermore, the second end 510*b* is formed, at a part opposite to a part facing on the bill insertion slot 3A, with an inclined surface 528 that is inclined toward the bill delivery passage L. In addition, in this embodiment, the second end 510*b* is formed, at a part facing on the bill insertion slot 3A, with an inclined surface 530 that is inclined toward the bill delivery passage.

In addition, in this embodiment, the bill delivery passage L has an engagement part 390 (refer to FIGS. 5 and 20B) that is engaged with the first end 510*a* of the swinging part 510A when the first end 510*a* blocks the bill insertion slot 3A. In addition, the bill delivery passage L is provided with an engagement part 392 (refer to FIG. 18B) that is engaged with the second end 510*b* of the swinging part 510A that blocks the bill delivery passage L.

Figure 5:
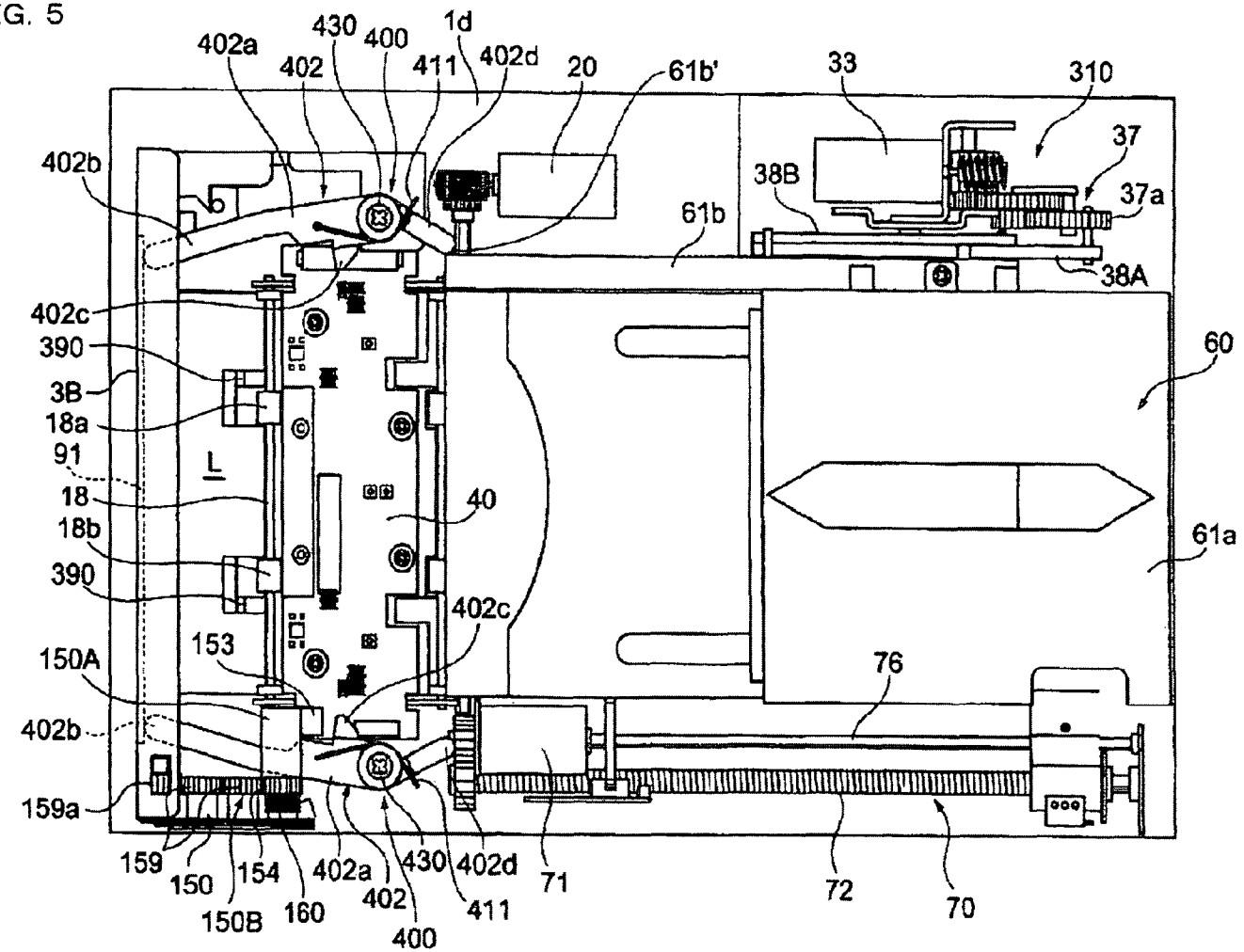
FIG. 5 is a plan view showing a state in which a support member of a shutter device is removed from the state of FIG. 4.
Figure 17:
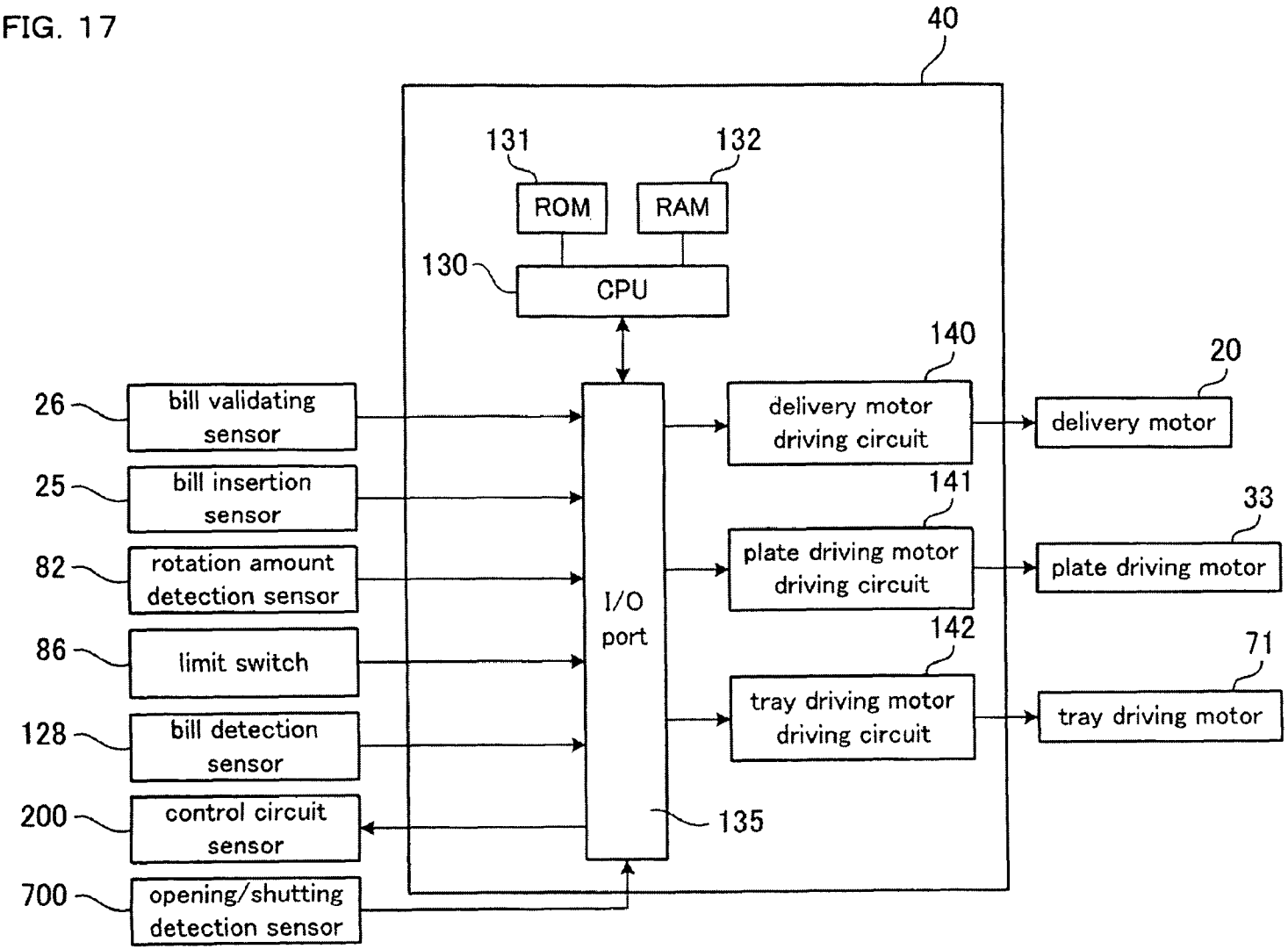
FIG. 17 is a block diagram showing an example of a control unit that controls an operation of a bill processing apparatus.

In addition, in this embodiment, a control substrate 40 (which constitutes the control unit) that controls a variety of the driving devices in the bill processing apparatus 1 is equipped in a space between the pivot members 402 of the lock device 400 (refer to FIG. 5). FIG. 17 is a block diagram that shows an example of the control unit controlling an operation of the bill processing apparatus 1.

As shown in FIG. 17, the control unit (control substrate 40) comprises a CPU 130 that has a function of controlling the various driving devices such as the delivery motor 20, the plate driving motor 33, the tray driving motor 71 and the like, a ROM 131 that stores an operating program of the driving devices, detection data about normal bill and the like, and a control RAM 132.

The CPU 130 is connected, via an I/O port 135, with motor driving circuits 140 to 142 that drives the various motors. The driving operation (rotation, counter-rotation, stop) of each driving motor is controlled by means of a control signal from the CPU 130 in accordance with the operating program. In addition, the CPU 130 is such adapted that a signal of detecting an insertion of bill from the bill insertion sensor 25, a detection signal about a determination of bill from the bill validating sensor 26, a detection signal about a position of the loading tray 60 from the rotation amount detection sensor 82, a detection signal from the limit switch 86, which indicates whether the loading tray 60 is at the receiving position, and a detection signal from the shield plate opening/shutting detection sensor 700 are inputted therein via the I/O port 135. Based on the detection signals, the driving of the delivery motor 20, the plate driving motor 33 and the tray driving motor 71 is controlled.

In addition, the CPU 130 is connected to a control circuit 200 that executes a game process arranged in a main body of a gaming machine (not shown) and transmits to the gaming machine game value information depending on a value of bill inserted.

In the followings, an operation of the bill processing apparatus 1 will be described. Firstly, an order of sequentially stacking the bill on the loading tray 60 will be described.

As shown in FIGS. 1 and 18A, when the bill P is inserted into the bill insertion slot 3A with the short side thereof being uprighted, the insertion is detected by means of the bill insertion sensor 25 (refer to FIG. 3). When the bill insertion sensor 25 detects that the bill is inserted, the delivery motor 20 is rotated and the bill P is delivered into the cabinet 1*a* with being held between the delivery belts 17*a*, 17*b*, which are respectively wound on the tension rollers 18*a*, 18*b* and the tension rollers 19*a*, 19*b*, and the pinch rollers 21*a*, 21*b* and the pinch rollers 22*a*, 22*b* that contact the respective tension rollers. In this case, since a gap S of about one medium piece only is formed between the first end 510*a* and the bill delivery passage L even in a state in which the second end 510*b* of the swinging member 510 is not contacted to the bill P (refer to FIG. 18A), further bill P is prevented from being inserted into the apparatus 1 while the bill P is delivered along the bill delivery passage L.

Figure 19:
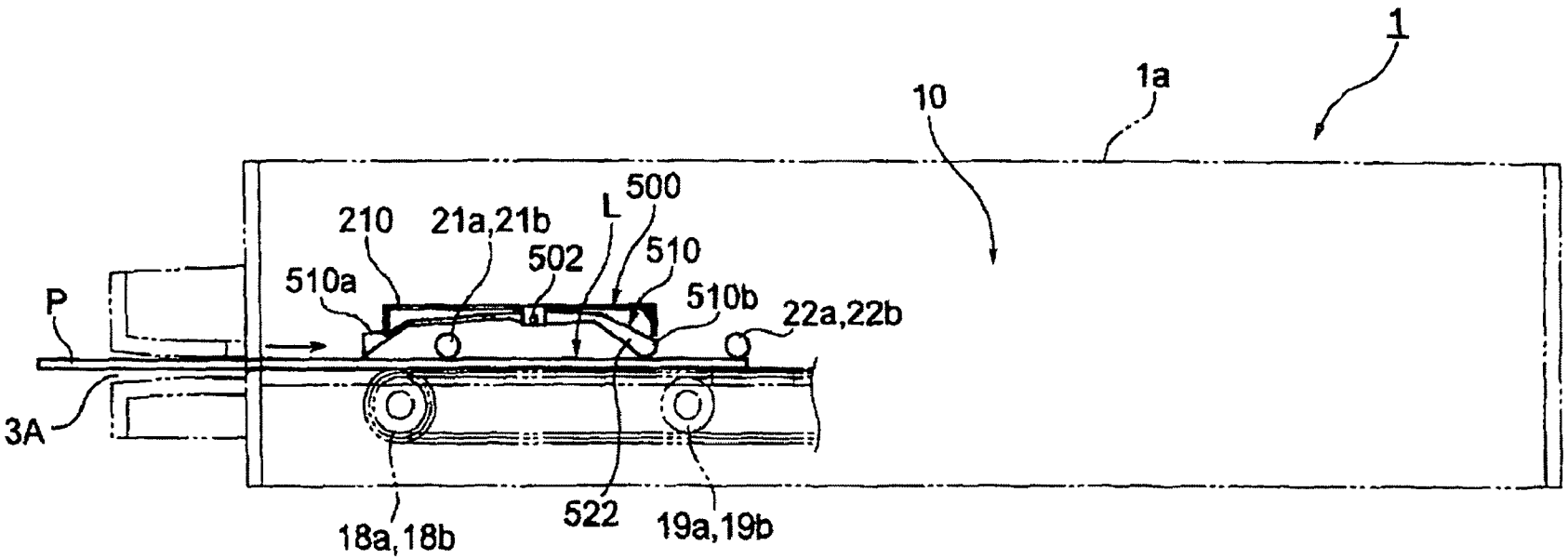
FIG. 19 shows a delivery operation of introducing bill in a press area through a bill insertion slot.

In addition, when the bill P is delivered in the cabinet 1*a* as described above, the bill validating sensors 26 detect the bill P, the validity of the bill P is determined in the control unit, the bill P delivered by the bill delivery passage L is contacted to the second end 510*b* and the swinging member 510 is correspondingly swung through the spindle 502, so that the first end 510*a* is moved to block the bill insertion slot 3A. Such a state is shown in FIG. 19. In this state, although the bill P contacts the first end 510*a*, the swinging member 510 is structured to be deformable by the contact with the bill P, so that the first end 510*a* itself is deformed to alleviate the shock to the bill P. Due to this, the bill P is not damaged.

In addition, when the bill P contacts the second end 510*b* and is thus further moved into the apparatus 1, the delivery is smoothly performed by means of a guide operation of the inclined surface 530 formed at the second end 510*b*.

In addition, when the bill P is further moved into the apparatus 1 from the state shown in FIG. 19 and thus the rear end of the bill P completely passes to the first end 510*a* (a state of FIG. 20A), the bill insertion slot 3A is completely blocked by means of the first end 510*a* and the first end 510*a* is engaged with the engagement part 390 of the bill delivery passage L, so that the blocked state is maintained. Like this, when the first end 510*a* is engaged with the engagement part 390 of the bill delivery passage L, the first end 510*a* is supported to the bill delivery passage L. Accordingly, it is possible to secure the high strength of the first end 510*a* against the shock generated from an outside of the bill insertion slot 3A. In addition, such action is promoted by the protrusion 520 provided to the first end 510*a*.

Figure 20A:
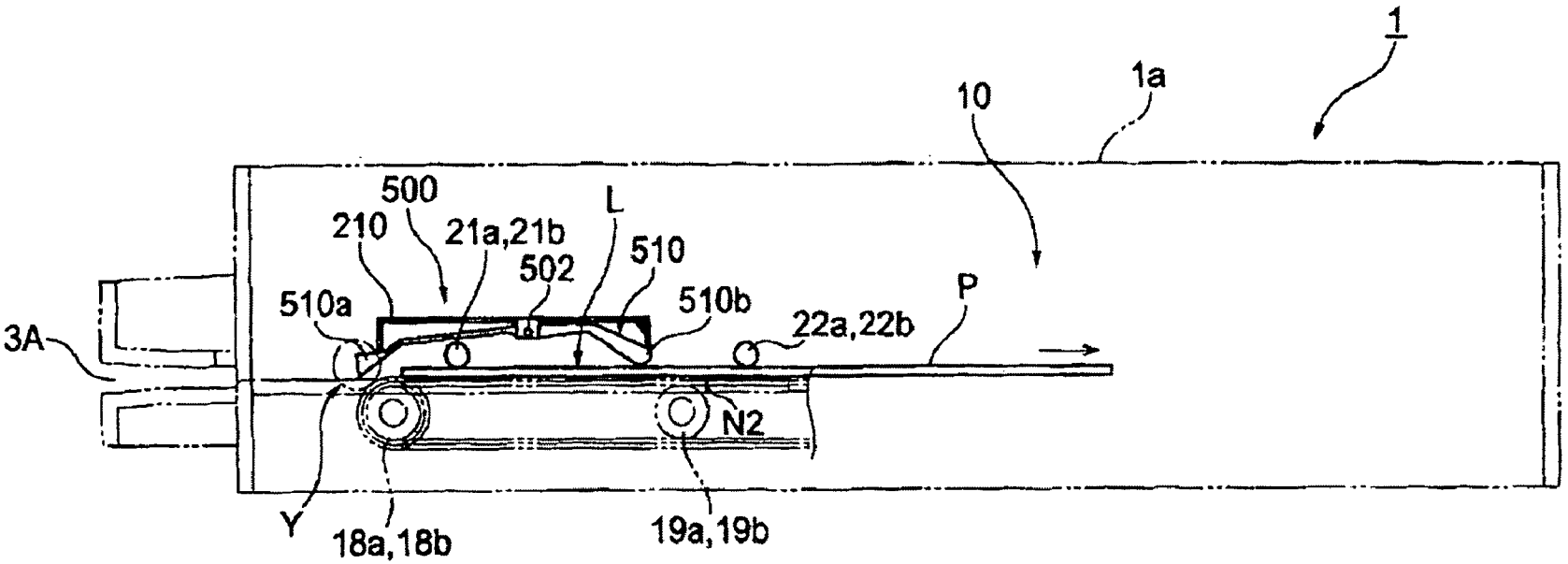
FIG. 20A shows a delivery operation of introducing bill in a press area through a bill insertion slot.
Figure 20B:
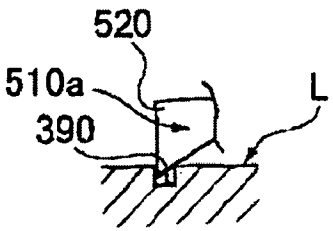
FIG. 20B shows a delivery operation of introducing bill in a press area through a bill insertion slot.

In addition, when the validity of the bill P is determined, the bill P is further moved into the apparatus 1 from the state of FIG. 20A and thus the rear end of the bill P completely passes to the second end 510*b* (a state of FIG. 21), the swinging member 510 is returned to its initial position same as in FIG. 18A and the bill delivery passage L is blocked by means of the second end 510*b*. In the delivery, the delivery motor 20 is rotated until the rear end of the bill P passes to a nip portion N2 between the tension rollers 19*a*, 19*b* and the pinch rollers 22*a*, 22*b*. In addition, when reaching the state of FIG. 21, even though the bill P is counter-delivered due to any error operation or intentional tension force from an outside (for example, illegal action) to be applied to the bill P, since the second end 510*b* is formed with the inclined surface 524 that is inclined to deviate from the bill delivery passage L, the bill P in the apparatus 1 having passed to the swinging member 510 overrides the inclined surface 524 by counter-delivery force, so that the counter-delivery toward the bill insertion slot 3A is prevented, as shown with dotted lines in FIG. 21. In addition, in the state of FIG. 21 (also the state of FIG. 18A), since the second end 510*b* is engaged with the engagement part 392 (refer to FIG. 18B) at the bill delivery passage L, it is possible to certainly maintain the shut state of the bill delivery passage L by means of the second end 510*b*, so that the counter-delivery of the bill can be securely prevented. Furthermore, the protrusion 526 formed at the second end 510*b* highly contributes to the counterforce against the counter-delivery.

In the mean time, when the bill validating sensors 26 cannot determine the validity of the bill P, the delivery motor 20 is counter-rotated and the bill P in the course of the delivery-in is applied with a return action and is thus discharged from the bill insertion slot 3A. The counter-delivery is smoothly performed by means of the inclined surface 522 formed at the first end 510*a* and the inclined surface 528 formed at the second end 510*b*.

Figure 21:
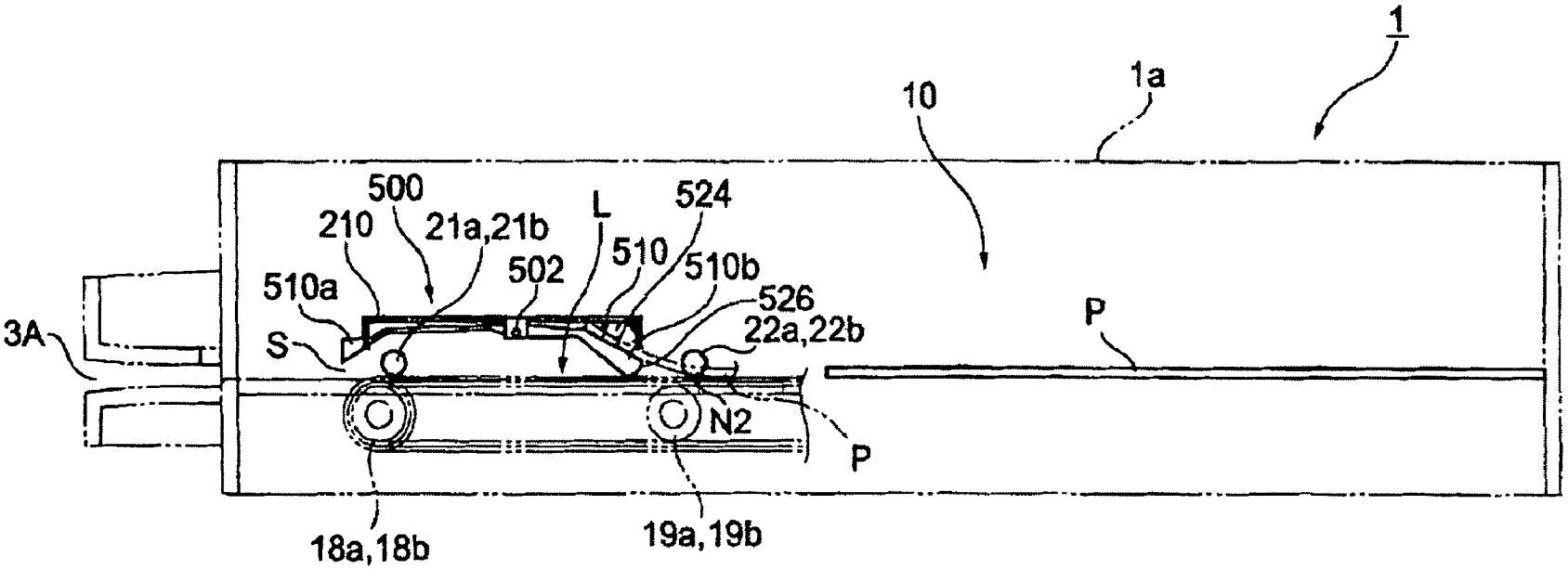
FIG. 21 shows a delivery operation of introducing bill in a press area through a bill insertion slot.
Figure 22:
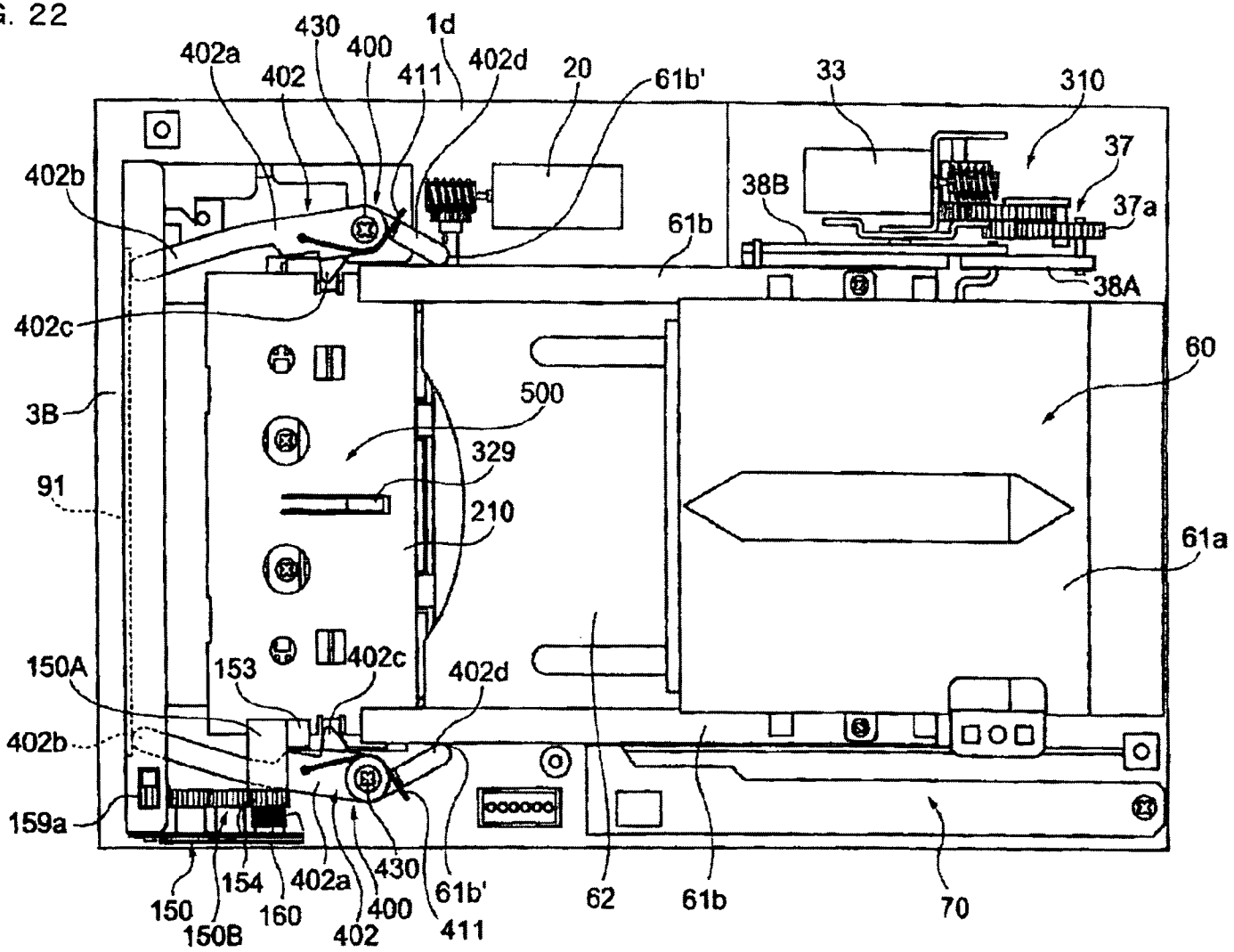
FIG. 22 shows a bill collection operation of moving a loading tray toward a bill collection slot.

The bill P delivered to the state shown in FIG. 21 is discharged to the gap R between press face of the press plate 32 of the bill press area 10 downstream of the tension rollers 19*a*, 19*b* and the pinch rollers 22*a*, 22*b* and the plane including the engagement portions 61*c* of the loading tray 60. Meanwhile, the gap R is set within a range so as not to cause a jam and a guide (not shown) may be provided downstream of the nip portion N2 so as to make the bill easily move into the gap R, as required.

When the rear end of the bill P has passed to the nip portion N2, the rotation of the delivery motor 20 is stopped and the plate driving motor 33 is rotated. Thereby, the press plate 32 is driven in a press direction by means of the swing press members 300, 302 and presses the bill with its lower surface (refer to FIG. 12B). At this time, in the operation of pressing the bill, the pressing operation timings by the press plate 30 are different between the movement of the bill P toward the loading tray 60 at one side of the press plate 32 and then the movement of the bill P toward the loading tray 60 at the other side of the press plate 32, due to the structure of the press device 30. Thereby, one side of the bill P is pressed and then the other side thereof is further pressed, so that the bill P is not bent and is tensioned between both sides thereof. As a result, even though the bill has a wrinkle, the wrinkle can be stretched, so that the bill P can be horizontally corrected and received. Furthermore, by the operation of the swing press members 300, 302, the bill P is pressed on the loading tray 60 while a position of the press operating point is changed along the longitudinal direction of the bill P. In other words, the bill P can be pressed on the loading tray 60 while moving the pressing force to be applied to the bill from one side thereof to the other side, so as to stretch the bent portion or wrinkle of the bill P. Therefore, it is possible to horizontally correct the bill P over an approximately entire length of the bill P. In addition, it is also possible to apply the pressing force to the bill received on the loading tray 60 in the same manner, by the pressing. As a result, it is possible to horizontally correct the bill while eliminating a gap that may occur between the bills stacked.

Like this, the bill P pressed by the press plate 32 overrides the engagement portions 61*c* of the loading tray 60 and then is pressed on the loading plate 62 against the biasing force of the biasing spring 63. The press plate 32 changes the pressing position to the bill, as described above. However, the flanges (flares) 32*c* formed at both sides of the press plate 32 collide with the engagement portions 61*c*, so that the bill P is applied with the approximately uniform pressing force along the longitudinal direction thereof. In other words, the entire bill can be firmly pressed, so that the predetermined number of bills can be received even though the bill P is bent or has a strong maintaining force (resulting from as the number of stacked bills is increased).

By applying the pressing force to the press plate 32 to make the flanges (flares) 32*c* contact the engagement portions 61*c*, the press plate 32 is returned to the initial position by the device described above. At this time, the loading plate 62 is biased toward the engagement portions 61*c* by the biasing force of the biasing spring 63 and the uppermost bill collides with the engagement portions 61*c*, as shown in FIG. 12C, so that a sorting process is made between the bills to be delivered subsequently.

By repeating the above operations, the bills are stably stacked on the loading plate 62 of the loading tray 60.

In the followings, an order of collecting the bills P received on the loading tray 60 will be described with reference to FIGS. 22 to 25.

When collecting the bill, a bill collection signal is transmitted to each bill processing apparatus 1 from a management server that manages an entire hall, or a corresponding switch of the bill processing apparatus 1 is pushed. Thereby, the tray driving motor 71 is rotated and the loading tray 60 is advanced to a wait position shown in FIG. 22 from a state of FIG. 4. In the mean time, in FIG. 4, since the front end face 61*b*' of the loading tray 60 contacts the protrusion pieces 402*d* of the pivot members 402, the lock device 400 is operated against the biasing force of the biasing spring 411 even though vibration is caused from an outside. Thereby, it is possible avoid an unpredictable situation that the lock is released.

Then, the tray driving motor 71 is re-driven and the loading tray 60 is moved toward the bill collection slot 3B. During the movement, the front ends of the sidewalls 61*b* of the loading tray 60 contact and push the first interlocking operation parts 402*c* of the pivot members 402 of the lock device 400 in a forward direction. Thereby, the pivot members 402 are pivoted outward about the spindle 403 against the biasing force of the biasing spring 411 and the contact parts 402*b* of the pivot members 402 are retreated to a lock release position shown in FIG. 23 from a lock position (position shown in FIG. 22) opposite to the shield plate 91. At this time, the protrusions 402*d* of the pivot members 402 enter the elongated grooves 230 formed at the sidewalls 61 of the loading tray 60.

Figure 23:
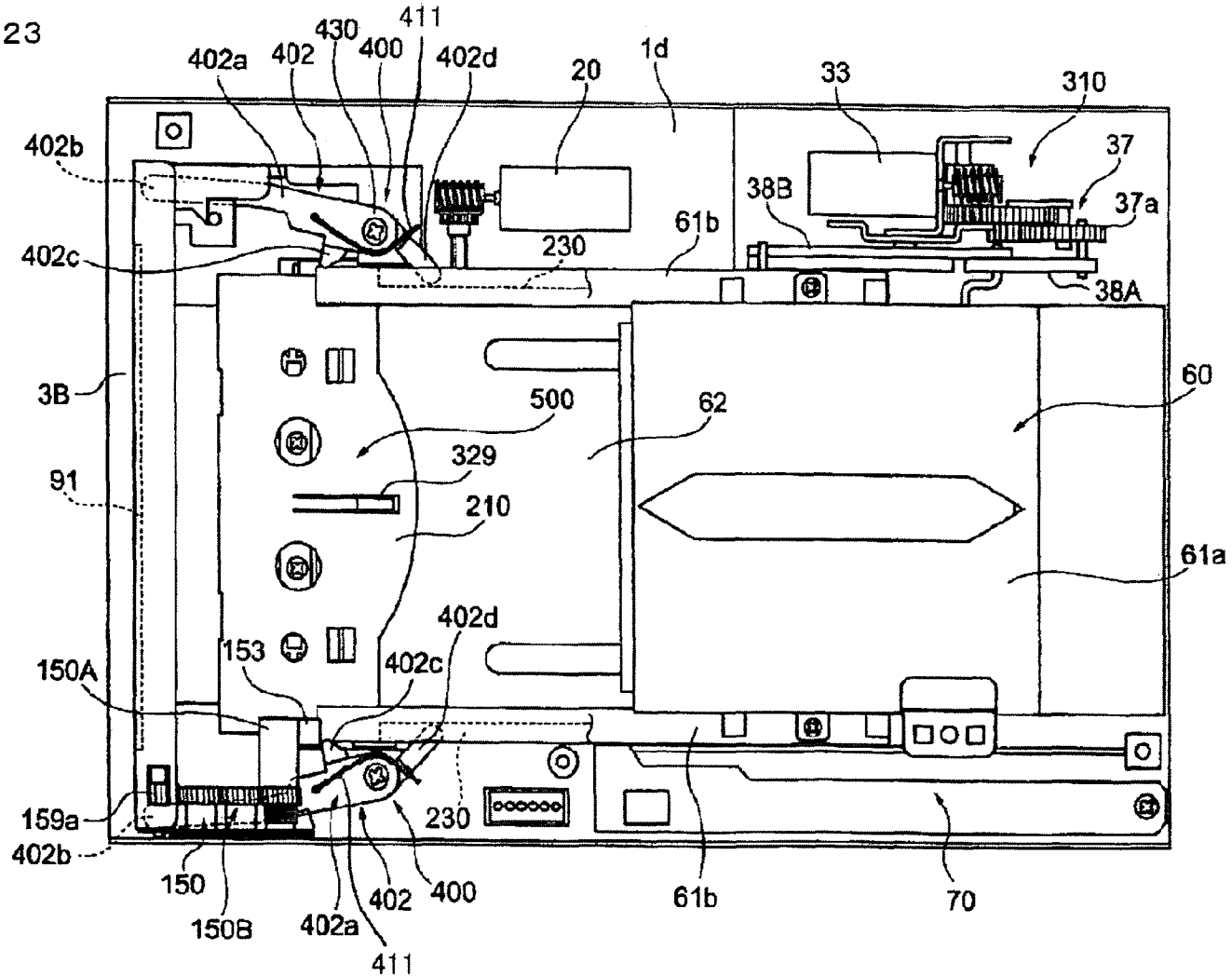
FIG. 23 shows a bill collection operation of moving a loading tray toward a bill collection slot.
Figure 24:
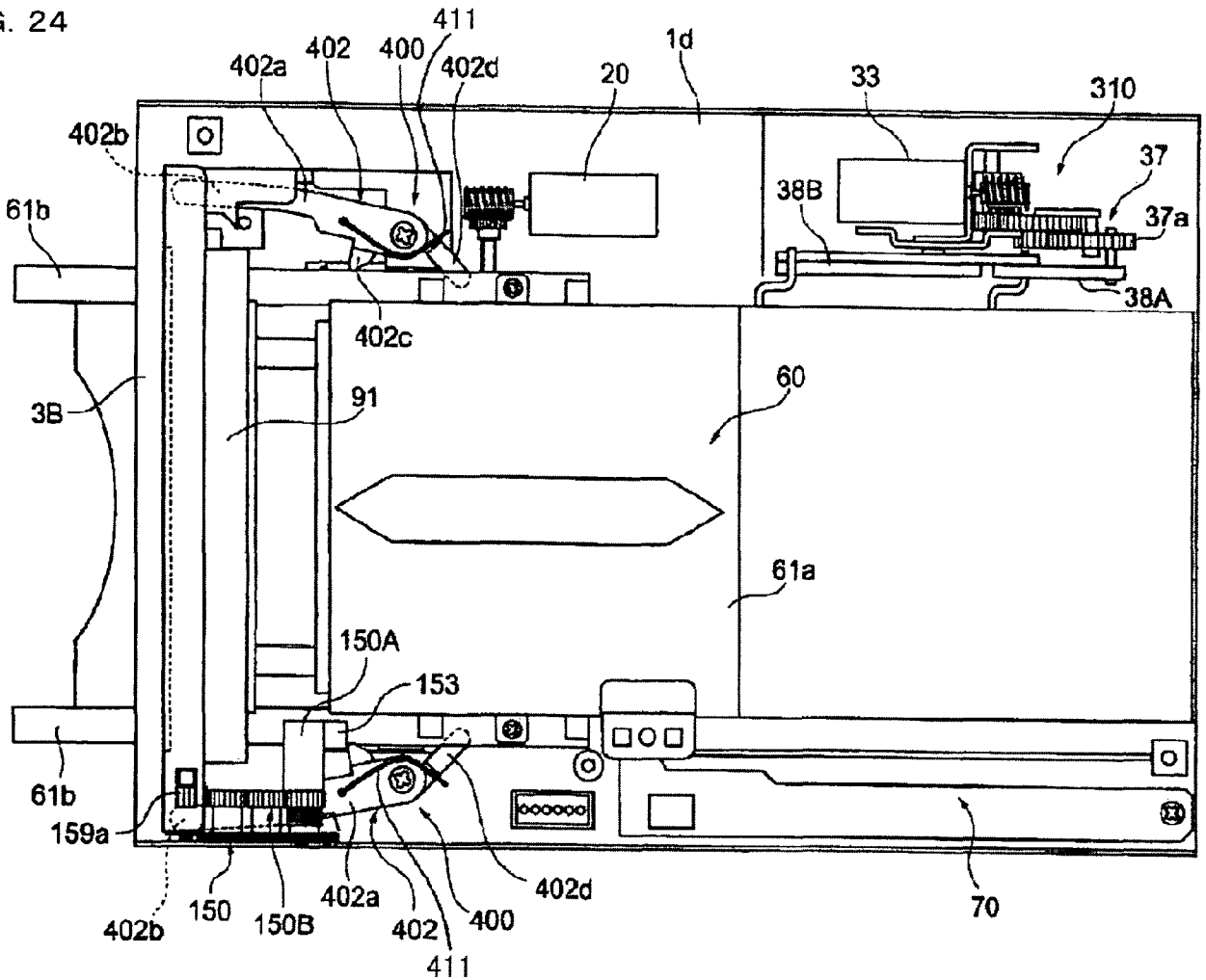
FIG. 24 shows a bill collection operation of moving a loading tray toward a bill collection slot.

In addition, when the loading tray 60 is further advanced from the state of FIG. 23 in which the lock of the shield plate 91 is released, the front ends of the sidewalls 61*b* of the loading tray 60 contact the second interlocking operation part 153 of the rotation member 150A of the opening/shutting device 150, so that the second interlocking operation part 153 overrides the sidewalls 61*b* of the loading tray 60. Due to this, the rotation member 150A is rotated, the shield plate 91 is pivoted toward an inside of the apparatus 1 through the gear device 150B and the bill collection slot 3B is opened (which is shown in FIG. 24). The opened state is maintained as the second interlocking operation part 153 overrides the sidewalls 61*b* of the long loading tray 60 by the sidewalls 61*b*. In the state of FIG. 24, the front end of the loading tray 60 is discharged from the front face of the cabinet 1*a* (refer to FIG. 25). As described above, since the sidewalls 61*b* of the main body 61 of the loading tray 60 are formed with the slit portions 61*d*, the sidewalls do not interfere with the shield plate 91 laid down and the front ends thereof are discharged. Meanwhile, the rotation amount of the tray driving motor 71 is detected by means of the rotation amount detection sensor 82 and the loading tray 60 is stopped at an appropriate position.

Under state that the loading tray 60 is stopped, the bill bundle stacked on the loading plate 62 is adapted to protrude at its front ends, as shown in FIG. 25. Therefore, an operator can grasp and withdraw the bill bundle, thereby effectively performing the collection operation. Particularly, in this embodiment, as shown in FIGS. 11A and 11B, the length of the loading plate 62 on which the bill is put is shorter than a length of the bill and a center of the leading edge of the loading plate 62 is formed with the recessed portion 62*a*. Accordingly, when the loading tray 60 is protruded, the bill bundle stacked can be grasped at the leading end thereof, so that the operation of collecting the bill can be easily performed.

As described above, according to the bill processing apparatus 1 of the embodiment, since the lock device 400 is mechanically operated in connection with the movement of the loading tray 60 that is moved by the movement device 70, it is possible to drive the lock device 400 as well as the movement device 70 using only a driving source of the movement device 70. Therefore, it is possible to drive the lock device 400 with low power consumption. In addition, since it is not necessary to provide a driving source for driving the lock device 400, the number of parts is decreased and the entire apparatus is thus made to be small.

In addition, according to the bill processing apparatus 1 of the embodiment, the loading tray 60 and the lock device 400 are interlockingly operated due to the contact therebetween. Accordingly, when the loading tray 60 is moved to the bill collection slot 3B by the movement device 70, the lock of the shield plate 91 shut can be released, so that the interlocking operation can be achieved with the small number of parts.

In addition, according to the bill processing apparatus 1 of the embodiment, since the lock device 400 is formed as the pivot members 402 having the first interlocking operation part 402*c*, the movement of the loading tray 60 that is moved toward the bill collection slot 3B by the movement device 70 and the movement (lock/lock release) of the lock device 400 can be easily interlocked mechanically in a small space.

In addition, according to the bill processing apparatus 1 of the embodiment, since the biasing spring 411 is provided which biases the pivot members 402 to the lock position, when the contact between the loading tray 60 and the first interlocking operation part 402*c* is released, the pivot members 402 can be automatically returned to the lock position. In other words, it is possible to always prevent the shield plate 91 from being opened except when the bill is collected, so that the safety in the bill collection can be secured.

In addition, according to the bill processing apparatus 1 of the embodiment, since the opening/shutting device 150 is mechanically operated in connection with the movement of the loading tray 60 that is moved by means of the movement device 70, it is possible to drive the opening/shutting device 150 as well as the movement device 70 and the lock device 40 using only a driving source of the movement device 70. Therefore, it is possible to drive the opening/shutting device 150 with low power consumption. In addition, since it is not necessary to provide a driving source for driving the opening/shutting device 150, the number of parts is decreased and the entire apparatus is thus made to be small. Furthermore, by providing the opening/shutting device 150, it is possible to secure the high strength of the shield plate 91 shut against the shock from an outside of the bill insertion slot 3B.

In addition, according to the bill processing apparatus 1 of the embodiment, the loading tray 60 and the opening/shutting device 150 are interlockingly operated due to the contact therebetween. Accordingly, when the loading tray 60 is moved to the bill collection slot 3B by the movement device 70, the shield plate 91 can be opened, so that the interlocking operation can be achieved with the small number of parts.

In addition, according to the bill processing apparatus 1 of the embodiment, since the opening/shutting device 150 consists of the rotation member 150A having the second interlocking operation part 153 and the gear device 150B engaged with the rotation member, the movement of the loading tray 60 that is moved toward the bill collection slot 3B by the movement device 70 and the movement (opening/shutting operation of the shield plate 91) of the opening/shutting device 150 can be easily interlocked mechanically in a small space.

In addition, according to the bill processing apparatus 1 of the embodiment, since the biasing spring 160 is provided which biases the rotation member 150A in a direction of shutting the shield plate 91, when the contact between the loading tray 60 and the second interlocking operation part 153 is released, the shield plate 91 can be automatically blocked. In other words, it is possible to maintain the blocked state of the shield plate 91 except when the bill is collected, so that the safety in the bill collection can be secured.

In addition, according to the bill processing apparatus 1 of the embodiment, since it is possible to maintain the opened state of the shield plate 91 by means of the sidewalls 61*b* of the loading tray 60 while the loading tray 60 is being moved, it is possible to smoothly perform the movement of the loading tray 60 through the bill collection slot 3B and to rapidly collect the bill.

The bill processing apparatus of the invention can be applied to a variety of apparatuses that handle bills, for example an exterior apparatus such as vending machine, as well as gaming machines.

Although the above descriptions have been provided with regard to the characteristic parts so as to understand the invention more easily, the invention is not limited to the embodiment as described above and can be applied to the other embodiments and the applicable scope should be construed as broadly as possible. Furthermore, the terms and phraseology used in the specification have been used to correctly illustrate the invention, not to limit it. In addition, it will be understood by those skilled in the art that the other structures, systems, methods and the like included in the spirit of the invention can be easily derived from the spirit of the invention described in the specification. Accordingly, it should be considered that the invention covers equivalent structures thereof without departing from the spirit and scope of the invention as defined in the following claims. Further, the abstract is provided so that an intellectual property office and a general public institution or one skilled in the art who is not familiar with patent and legal or professional terminology can quickly analyze the technical features and essences of the invention through a simple investigation. Accordingly, the abstract is not intended to limit the scope of the invention that should be evaluated by the claims. In addition, it is required to sufficiently refer to the documents that have been already disclosed, so as to fully understand the objects and effects of the invention.

The above descriptions include a process that is executed on a computer or computer network. The above descriptions and expressions have been provided so that the one skilled in the art can understand the invention most effectively. In the specification, the respective steps used to induce one result or blocks having a predetermined processing function should be understood as a process having no self-contradiction. In addition, the electrical or magnetic signal is transmitted/received and written in the respective steps or blocks. Although the processes in the respective steps or blocks embody the signal as a bit, value, symbol character, term, number and the like, it should be noted that these have been used for the convenience of descriptions. Further, although the processes in the respective steps or blocks have been often described as an expression common to a human action, the process described in the specification is executed by a variety of devices in principle. In addition, the other structures necessary for the respective steps or blocks are apparent from the above descriptions.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A bill processing apparatus comprising:

a bill receiver that receives a bill inserted and delivered through a bill insertion slot;

a bill collection slot that collects the bill received in the bill receiver;

an openable shield plate that shuts the bill collection slot;

a movement device that moves the bill receiver toward the bill collection slot; and a lock device that locks a shut state of the shield plate to be released, wherein the lock device is mechanically operated in connection with the movement of the bill receiver that is moved by the movement device, wherein the lock device contacts the bill receiver that is moved toward the bill collection slot by the movement device, thereby releasing a lock of the shield plate shut, wherein the lock device comprises a pivot member that is pivoted between a lock position at which the lock device is opposite to the shield plate to obstruct the shield plate from being opened, and a lock release position at which the lock device retreats from the shield plate to allow the shield plate to be opened, and wherein the pivot member has a first interlocking operation part that is protruded into a movement path of the bill receiver and is pivoted from the lock position to the lock release position as the bill receiver to be moved toward the bill collection slot by the movement device is contacted to the first interlocking operation part.

2. The bill processing apparatus according to claim 1, further comprising a biasing member that biases the pivot member toward the lock position.

3. A bill processing apparatus comprising:

a bill receiver that receives a bill inserted and delivered through a bill insertion slot;

a bill collection slot that collects the bill received in the bill receiver;

an openable shield plate that shuts the bill collection slot;

a movement device that moves the bill receiver toward the bill collection slot;

a lock device that locks a shut state of the shield plate to be released; and an opening/shutting device that opens/shuts the shield plate, wherein the lock device is mechanically operated in connection with the movement of the bill receiver that is moved by the movement device, wherein the opening/shutting device is mechanically operated in connection with the movement of the bill receiver that is moved by the movement device, wherein the opening/shutting device contacts the bill receiver, which is moved toward the bill collection slot under state that the lock of the shield plate shut is released, thereby opening the shield plate, wherein the opening/shutting device comprises a rotation member which has a second interlocking operation part protruding into a movement path of the bill receiver and a gear device that is engaged with the rotation member and converts rotation force of the rotation member into an opening/shutting operation of the shield plate, and wherein the bill receiver, which is moved toward the bill collection slot by means of the movement device, contacts the second interlocking operation part to rotate the rotation member in one direction, so that the shield plate is opened by means of the gear device.

4. The bill processing apparatus according to claim 3, further comprising a biasing member that biases the rotation member in a direction opposite to the one direction.

5. The bill processing apparatus according to claim 3, wherein the bill receiver has an opening maintain unit that maintains an opened state of the shield plate after contacting the second interlocking operation part.

6. A bill processing apparatus comprising:

a bill receiver that receives a bill inserted and delivered through a bill insertion slot;

a bill collection slot that collects the bill received in the bill receiver;

an openable shield plate that shuts the bill collection slot;

a movement device that moves the bill receiver toward the bill collection slot; and a lock device that locks a shut state of the shield plate to be released, wherein the lock device is mechanically operated in connection with the movement of the bill receiver that is moved by the movement device, wherein the movement device moves the bill receiver between a bill receiving position for receiving the bill in the bill receiver and a bill collection position at which the bill receiver is protruded from the bill collection slot, and wherein the bill receiver has a lock release prevention unit that is engaged with the lock device at the bill receiving position to prevent the lock of the shield plate shut from being released.

7. The bill processing apparatus according to claim 6, wherein the bill receiver has a prevention release unit that releases the lock release prevention state by the lock release prevention unit, accompanying with the movement of the bill receiver toward the bill collection slot by the movement device.

8. The bill processing apparatus according to claim 7, wherein the prevention release unit has elongated grooves that are formed along the sidewalls of the bill receiver.

9. The bill processing apparatus according to claim 6, wherein:

the lock device comprises a pivot member that is pivoted between a lock position at which the lock device is opposite to the shield plate to obstruct the shield plate from being opened, and a lock release position at which the lock device retreats from the shield plate to allow the shield plate to be opened;

the lock release prevention unit prevents the lock of the shield plate shut from being released, by having a protrusion piece of the rear end of the pivot member contact a front end face of a sidewall of the bill receiver at the bill receiving position.

10. A bill processing apparatus comprising:

a bill receiver that receives a bill inserted and delivered through a bill insertion slot;

a bill collection slot that collects the bill received in the bill receiver;

an openable shield plate that shuts the bill collection slot;

a movement device that moves the bill receiver toward the bill collection slot;

a lock device that locks a shut state of the shield plate to be released; and a detection member that detects an opened/shut state of the shield plate, wherein the lock device is mechanically operated in connection with the movement of the bill receiver that is moved by the movement device, wherein the detection member comprises a detection piece of a protrusion type that is formed at an end edge opposite to a pivot axis that is a central axis of the opening/shutting operation of the shield plate, and a shield plate opening/shutting detection sensor that has a receiving recessed portion that receives the detection piece when the shield plate is opened.

* * * * *